US008951075B2

(12) United States Patent
Ekchian

(10) Patent No.: US 8,951,075 B2
(45) Date of Patent: Feb. 10, 2015

(54) MULTI-PIECE ELECTRICAL CONNECTOR

(76) Inventor: Jack A. Ekchian, Belmont, MA (US)

( * ) Notice: Subject to any disclaimer, the term of this patent is extended or adjusted under 35 U.S.C. 154(b) by 23 days.

(21) Appl. No.: 13/374,671

(22) Filed: Jan. 6, 2012

(65) Prior Publication Data

US 2012/0178310 A1 Jul. 12, 2012

Related U.S. Application Data

(60) Provisional application No. 61/460,689, filed on Jan. 6, 2011, provisional application No. 61/574,828, filed on Aug. 10, 2011, provisional application No. 61/630,000, filed on Dec. 2, 2011.

(51) Int. Cl.

| | |
|---|---|
| ***H01R 13/04*** | (2006.01) |
| ***H01R 24/30*** | (2011.01) |
| ***H01R 13/453*** | (2006.01) |
| ***H01R 31/06*** | (2006.01) |
| *H01R 103/00* | (2006.01) |

(52) U.S. Cl.

CPC ..... *H01R 24/30* (2013.01); *H01R 13/4538* (2013.01); *H01R 31/06* (2013.01); *H01R 2103/00* (2013.01)

USPC ..... 439/692; 439/170; 439/638

(58) Field of Classification Search

USPC ..... 439/692, 638, 141, 170, 171, 172, 173, 439/174, 365, 300, 106, 364

See application file for complete search history.

(56) References Cited

U.S. PATENT DOCUMENTS

| | | | | |
|---|---|---|---|---|
| 1,870,762 | A * | 8/1932 | Winter | 200/51.05 |
| 2,480,787 | A * | 8/1949 | Stephan | 200/51 LM |
| 3,775,727 | A * | 11/1973 | Wise | 439/105 |
| 4,494,809 | A * | 1/1985 | Soloman | 439/369 |
| 4,579,410 | A * | 4/1986 | Soloman | 439/133 |
| 5,513,998 | A * | 5/1996 | Kim | 439/170 |
| 6,247,941 | B1 * | 6/2001 | Lee et al. | 439/105 |
| 6,398,589 | B1 * | 6/2002 | Congelliere | 439/655 |
| 6,592,406 | B2 * | 7/2003 | Liu | 439/620.31 |
| 6,669,495 | B2 * | 12/2003 | Philips et al. | 439/170 |
| 7,040,931 | B1 * | 5/2006 | Achtner et al. | 439/651 |
| 7,249,976 | B1 * | 7/2007 | Watson | 439/651 |
| 7,465,176 | B2 * | 12/2008 | Liao | 439/172 |
| 7,658,635 | B2 * | 2/2010 | Gilchrist | 439/357 |
| 8,052,441 | B2 * | 11/2011 | Senatori et al. | 439/171 |
| 8,079,878 | B2 * | 12/2011 | Huang | 439/660 |
| 8,496,491 | B2 * | 7/2013 | Baek et al. | 439/188 |
| 2012/0220167 | A1 * | 8/2012 | Walls, Jr. | 439/638 |

* cited by examiner

*Primary Examiner* — Hae Moon Hyeon

(57) ABSTRACT

Electric plugs or connectors are provided where protruding prongs are protected or reinforced by a brace element or configured to be readily replaceable. The brace element is used to buttress the prongs when the plug is not plugged into an electric receptacle. The brace element is configured to be deployed either manually or automatically.

20 Claims, 23 Drawing Sheets

MULTI-PIECE ELECTRICAL CONNECTOR

CROSS-REFERENCE TO RELATED APPLICATIONS

This application claims priority of U.S. Provisional Patent Applications No. 61/460,689, filed Jan. 6, 2011; No. 61/574,828, filed Aug. 10, 2011; and No. 61/630,000, filed Dec. 2, 2011, which are hereby incorporated herein by reference in their entirety.

FIELD OF INVENTION

The present invention generally relates to electrical connectors with protruding prongs that are used to connect to a receptacle that receives the prongs. In particular, it relates to the protection of such prongs from damage or the facilitating of their replacement when damaged.

BACKGROUND

Home appliances, power tools, space heaters, and other equipment that consume electric power are ubiquitous in society. In order to operate properly, such devices frequently rely on electrical connectors or plugs to connect to an alternating or direct current source. Such connectors frequently utilize protruding prongs of various shapes and lengths that, in use, are intended to mate with matching receiving terminals of a receptacle. Such prongs are typically supported only at one end, i.e. at the point of attachment to the plug base. They necessarily act as cantilever beams if and when they are exposed to forces or components of forces that are perpendicular to their longitudinal axes. The common two or three prong 110/120 volt alternating current plugs are examples of such connectors. They are typically used to supply AC power to various types of apparatus. Such plugs typically comprise a molded plug base with two or three protruding prongs embedded in the base on one side and a cord or cable, with two or three conductors, attached to another side of the plug base. The plug base is frequently fabricated by encapsulating the electrical connections, between the prongs and the conductors in the cord, in a plastic material to form a rugged and durable unitary piece. Typically, overmolding and/or insert molding processes are used. The 110/120 volt AC plugs, in common use in the USA, have two substantially flat or blade prongs. When plugged into a receptacle, these flat prongs act as the line voltage and neutral connections. A third prong that is substantially in the shape of a circular cylinder is typically added for safety and connects to the ground lead in a receptacle. Other types of alternating and direct current electrical connectors or plugs, that are in use worldwide, have various numbers of prongs of various shapes and purposes.

The prongs of such connectors are typically positioned and oriented as necessary to properly mate with the matching receptacles. The spacing of the prongs and the materials used in the fabrication of the plug have to be such as to avoid the excessive leakage of current and minimize the risk of a short circuit. The prongs are also sufficiently spaced from the outer edges of the plug base to reduce the chance of electrical shock and also to help maintain the physical integrity of the plug base.

Plugs, especially those utilized in a commercial or industrial environment such as, for example, a construction site, are frequently exposed to rough usage. Such plugs may be attached to, for example, the cord of an electric tool or apparatus or an extension cord. Typically the plug base and the cord are rugged enough to withstand such usage with little ill effect. When the prongs are fully engaged in a receptacle, they too are usually well protected from damage. However, when not in use, plugs are frequently left exposed, for example, on the floor of a construction site. Under such circumstances, the prongs are frequently damaged by forces that cause them to bend and twist. For example, prongs are frequently crushed when they are stepped on, run over by wheels of various pieces of equipment or hit by, for example, dropped tools or other heavy objects. They are, therefore, frequently bent and deformed. They then have to be straightened and untwisted so that they may be plugged into a receptacle.

Repeated bending and straightening is not only a nuisance, but can be dangerous. Frequently, metal prongs fatigue and break off after repeated bending. Under such circumstances, the entire cord or at least the plug needs to be replaced even though the plug base and the cord are completely sound. Even when the plug alone is replaced, it is still an added expense and a nuisance. Typically the electric cord must be cut to separate the damaged plug and the cord. The conductors in the cord have to then be stripped and attached to what are typically screw terminals in a replacement plug. Replacement plugs are typically not as rugged or robust as original injection molded plugs. Also, since they are typically installed by non-electricians, use of replacement plugs increases the risk of causing a short circuit, damaging equipment, and even causing injury or electrocution.

In certain circumstances, especially in the case where only the ground prong breaks off, the plug is used with a missing prong, which increases the likelihood of malfunction, and the danger of electrocution, personal injury or damage to equipment. Prongs that have been repeatedly bent cannot be fully straightened and as a result frequently do not fit properly in a receptacle and can damage the receptacle as well. Examples of electrical connectors are disclosed in U.S. Pat. Nos. 5,320,560 and 5,567,175, the contents of which are incorporated herein by reference in their entirety.

SUMMARY OF INVENTION

One object of the present invention is to protect exposed, protruding prongs of an electric plug or connector, from being crushed or otherwise damaged, for example, by being stepped on.

In an embodiment according to the invention, an electric plug or connector is configured to include an integral brace element for buttressing the prongs of the plug. The brace element may be withdrawn to allow the plug to be received normally in a receptacle. When the plug is not engaged in a receptacle, the brace element may be deployed to augment the degree to which at least one prong is supported. It is preferred that the brace element buttress and shield the prongs.

In another embodiment according to the invention, an electric plug or connector is configured to include an integral deployable shield for protecting the prongs of the plug.

It is preferred that the brace element both support and shield the prongs of a plug when it is deployed. More preferably, the brace element is an integral element of the plug that is slidably attached to at least two prongs and the plug base. It is yet more preferable that when the brace element is fully deployed, at least two prongs are buttressed against lateral movement by being securely bound together by the brace element at a point at or near their distal ends.

The brace element or shield may be deployed manually after the plug is withdrawn from the receptacle. Alternatively, the brace element or shield may be deployed automatically by an actuator when the plug is withdrawn.

In another embodiment according to the invention, the brace element is configured as a dummy receptacle which may be attached to, for example, the plug or its cord. The dummy receptacle may be attached to the plug or to its cord by using, for example, elastic straps, screws, snaps, sleeves, collars and/or adhesives. The dummy receptacle may be configured to shield and/or support and buttress the protruding prongs of a plug and not to supply electricity. For example, an extension cord may be configured comprising a three prong male connector at one end, a female plug with one or more sets of receiving terminals at the other end, and a dummy receptacle attached to the cord. It is preferred that the dummy receptacle be flexibly attached, to the electric cord, in close proximity to the male plug or to the male plug itself. When attached to the cord, it is preferred that the point of attachment be less than or equal to approximately one foot from the male plug. It is yet more preferred that the point of attachment be less or equal to approximately one inch from the male plug.

The plug may be plugged into the dummy receptacle when it is withdrawn from an electric receptacle so that the prongs are protected. It is preferred that when the prongs are engaged in a dummy receptacle at least one prong is supported and protected along its entire length. It is preferred that the outer dimensions of the dummy receptacle, in the transverse direction, closely approximate those of the plug. Therefore, when the plug is plugged into the dummy receptacle, preferably a smooth transition would occur between the outer dimension of the plug and that of the dummy receptacle. It is still further preferred that the outer envelope of the cross section of the plug be approximately a minor image of that of the dummy receptacle about the plane where the two are joined.

Another object of this invention is to retrofit a conventional plug with a detachable plug adapter that is fitted with an integral brace element that is configured to support and/or protect the prongs of the adapter when the brace element is deployed. The prongs of the conventional plug are simultaneously protected by being plugged into corresponding receiving terminals of the plug adapter. It is preferred that the adapter be attached to the conventional plug by a positive attachment device such as, for example, a screw.

The brace element of the adapter may be deployed manually after the adapter is withdrawn from the receptacle. Alternatively, the brace element may be deployed automatically by an actuator when the adapter is withdrawn from a receptacle.

It is a further object of this invention to facilitate the replacement of damaged prongs of an electrical plug so that it may be performed inexpensively and quickly, even by non-electricians.

In still another embodiment according to the invention, an electric plug is configured such that it comprises two readily separable mating pieces. One of these mating pieces, the prong assembly, comprises two or more prongs, each of which is electrically connected to a terminal or electrical contact. It is preferred that the prong assembly be fabricated by an injection molding process that encapsulates the electrical connections between each prong and its corresponding terminal.

The second of the mating pieces, the plug base, comprises connections between conductors within the electrical cord with the corresponding electrical terminals or contacts. The terminals in the two pieces of the plug are configured such that, when the constituent pieces of the plug are attached together, the corresponding terminals of the constituent pieces of the plug make electrical contact such that each prong in the prong assembly is electrically connected to a corresponding conductor in the electrical cord. It is preferred that the plug base be fabricated by an injection molding process that encapsulates the connections between each of the conductors in the electrical cord and the corresponding plug base terminal.

In yet a further embodiment according to the invention, a plug or a plug adapter is configured which comprises individually removable prongs that may be easily replaced by an untrained person if any such prong is damaged.

DETAILED DESCRIPTION OF INVENTION

Figure 1:
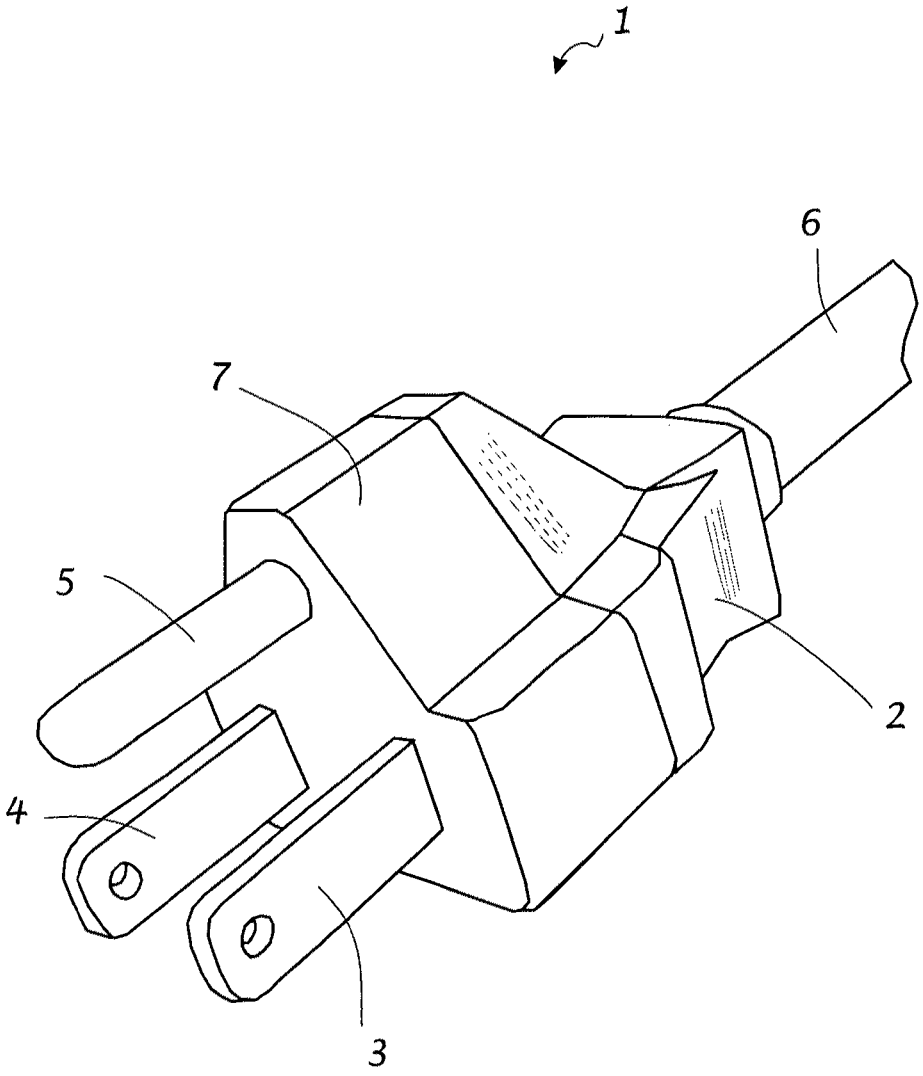
FIG. 1 shows a schematic of a perspective view of a three prong plug configured according to an embodiment of the invention comprising a brace element in a retracted position.

FIG. 1 shows a schematic of a three prong plug 1, configured according to an embodiment of the invention, comprising plug base 2, prongs 3, 4, and 5, electrical cord 6, and integral brace element 7. Brace element 7 is slidably attached to and integral with plug base 2. Plug 1 may be attached, for example, to one end of a power cord, such as an extension cord or the electric cable of a tool or appliance. Electrically conductive prongs 3, 4 and 5 are connected to three mutually insulated conductors (not shown) within an insulated electric cord or cable 6. The plug base 2 encapsulates the connections between prongs 3, 4, and 5 and the corresponding conductors in the electrical cord 6. Plug base 2 may be fabricated, for example, from a plastic material by injection molding. A plastic plug base may be produced by, for example, using an overmolding or insert molding process. In the case, for example, of a typical NEMA 5-15 plug, prongs 3, 4, and 5 would connect to the hot, neutral and ground terminals respectively when plugged into a matching electrical receptacle. NEMA5-15 is a designation of a plug configuration promulgated by the National Electrical Manufacturers Association (NEMA). This NEMA standard specifies the standard size and placement of prongs for 15 ampere three prong plugs commonly used in the United States. Brace element 7 is shown in its retracted position in FIG. 1. It is preferred that plug 1 in FIG. 1 be configured such that, when the brace element is retracted, there is a substantially smooth transition between the outer envelope of plug base 2 and the outer envelope of the brace element 7. This will reduce possible interference among multiple plugs that are plugged into adjacent receptacles, and also help reduce the concentration of externally induced stresses in the brace element, for example, when the plug is exposed to crushing forces.

Figure 2A:
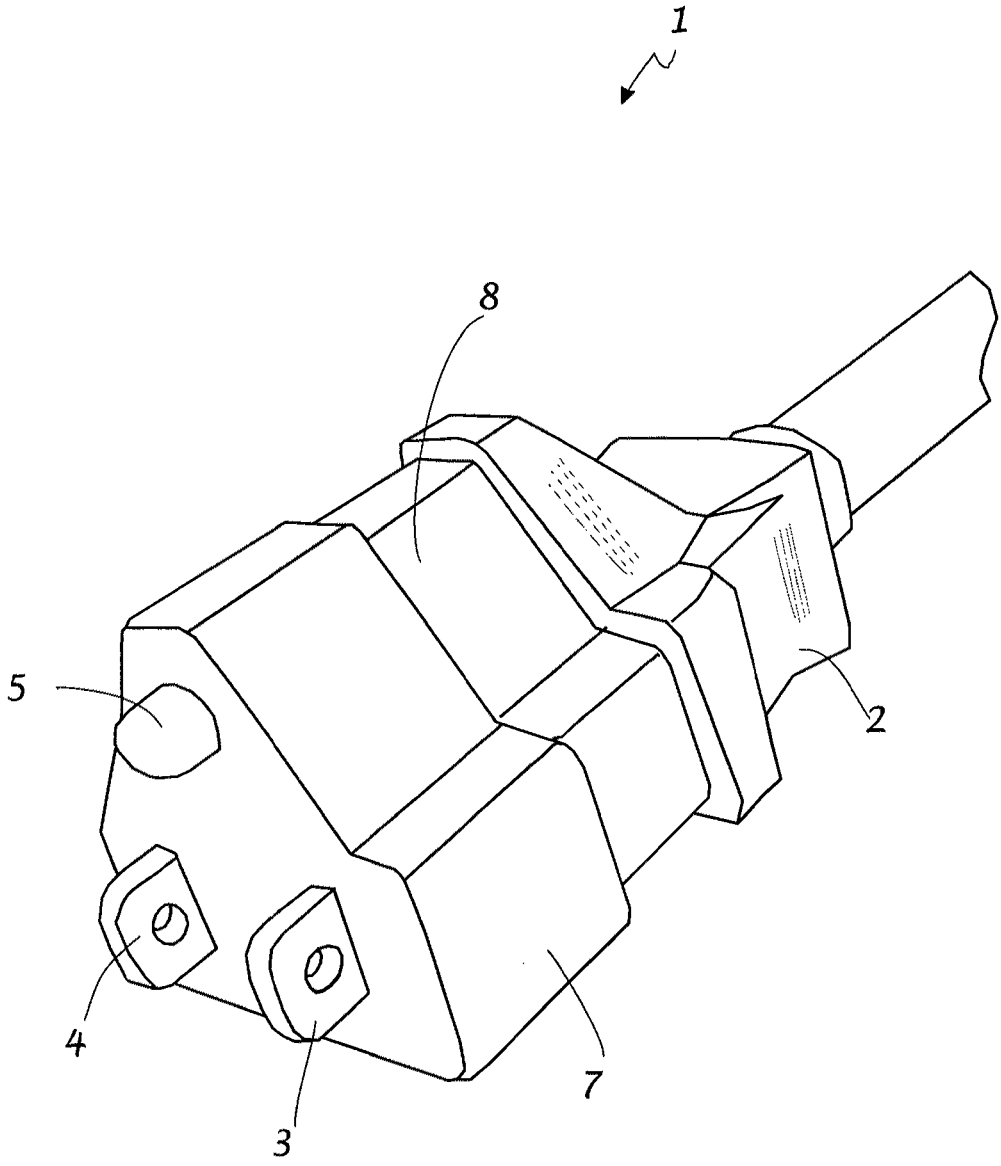
FIG. 2*a* shows a schematic of a perspective view of the plug in FIG. 1 with the brace element in a deployed position.

FIG. 2*a* shows a schematic of the three prong plug 1 of FIG. 1 with the brace element 7 in a deployed position shielding substantially the entire length of prongs 3, 4 and 5 and bracing them against each other. Plug base 2 has an exposed segment 8 that is uncovered by the deployment of the brace element 7. The exposed segment 8 of plug base 2 is hidden by the brace element 7 when it is fully retracted.

The exemplary embodiment of the brace element shown in FIG. 1 and FIG. 2*a* is configured to operate with two flat blade prongs and a third prong that has the shape, substantially, of a circular cylinder. However, a brace element may be configured to accommodate any number of prongs of various shapes and sizes.

Figure 2B:
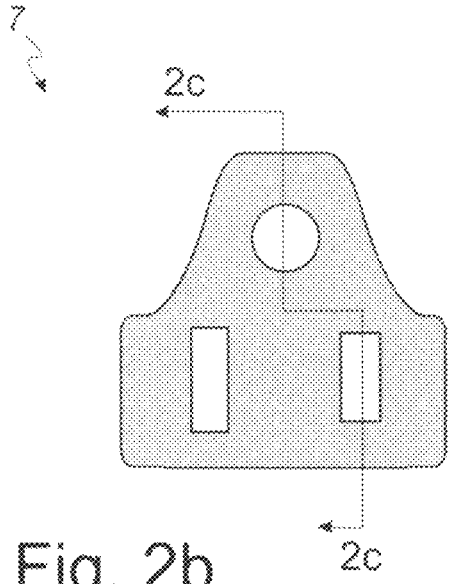
FIG. 2*b* shows a schematic of an orthogonal end view of the brace element shown in FIG. 1 and FIG. 2*a*.
Figure 2C:
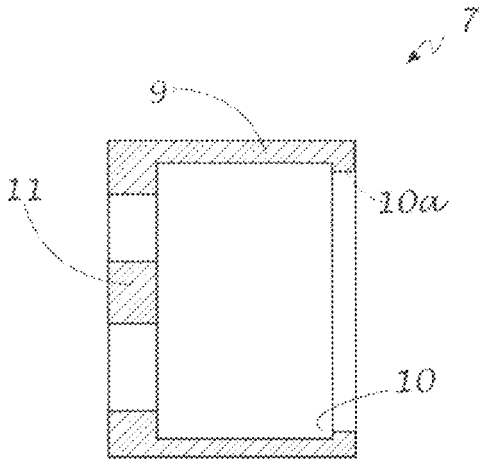
FIG. 2*c* shows a schematic of an orthogonal side view of the brace element shown in FIG. 1, FIG. 2*a* and FIG. 2*b*. The brace element is shown in section.

FIG. 2*b* shows a schematic of an end view of the brace element 7 of FIG. 1 and FIG. 2*a* with the three openings configured to closely and slidably receive prongs 3, 4, and 5 shown in FIG. 1 and FIG. 2*a*. FIG. 2*c* shows a sectioned side view of brace element 7 which comprises a substantially cylindrical section 9 with a stop 10 at one end, and a web-plate 11 at the other. The web-plate 11 is configured with holes that allow the plate to slide along and be guided by the prongs. The web-plate supports the prongs and braces them against each other. The cylindrical section 9 and radially inwardly protruding ridge 10*a* also assist in guiding the motion of the brace element 7. The stop 10 limits the motion of the brace element so that it does not slip off the end of the prongs when deployed. The brace element can be made of one or more conducting and non-conducting materials such as, for example, plastics, ceramics and metals. Materials of high strength are preferred so long as the use of conductive materials does not interfere with the proper and safe operation of the plug, such as, for example, by electrically shorting a line voltage prong with a ground prong or exposing users to electrical shock.

Figure 3C:
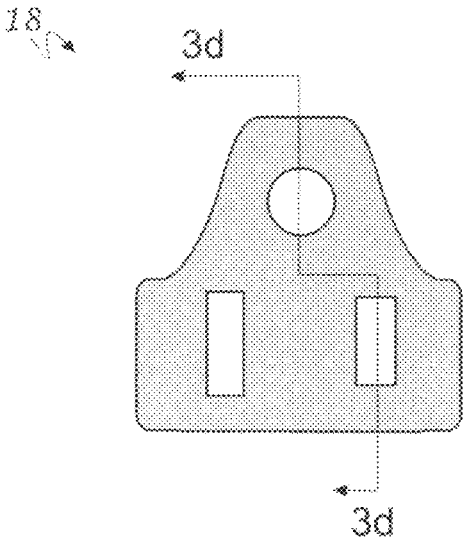
FIG. 3*c* shows a schematic of an orthogonal end view of the brace element shown in FIG. 3*a* and FIG. 3*b*.
Figure 3D:
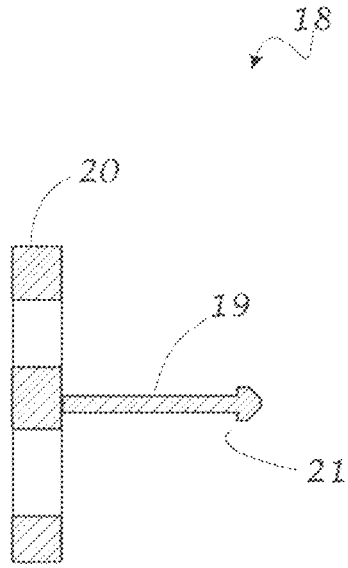
FIG. 3*d* shows a schematic of an orthogonal side view of the brace element shown in FIG. 3*a*, FIG. 3*b* and FIG. 3*c*. The brace element is shown in section.
Figure 3A:
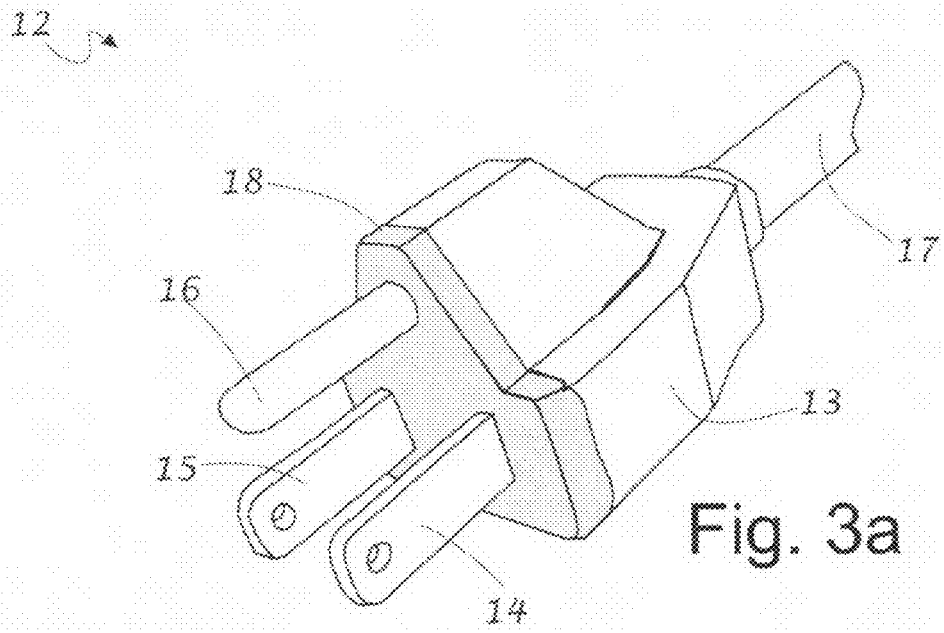
FIG. 3*a* shows a schematic of a perspective view of a three prong plug, configured according to another embodiment of the invention, with a brace element in a retracted position.
Figure 3B:
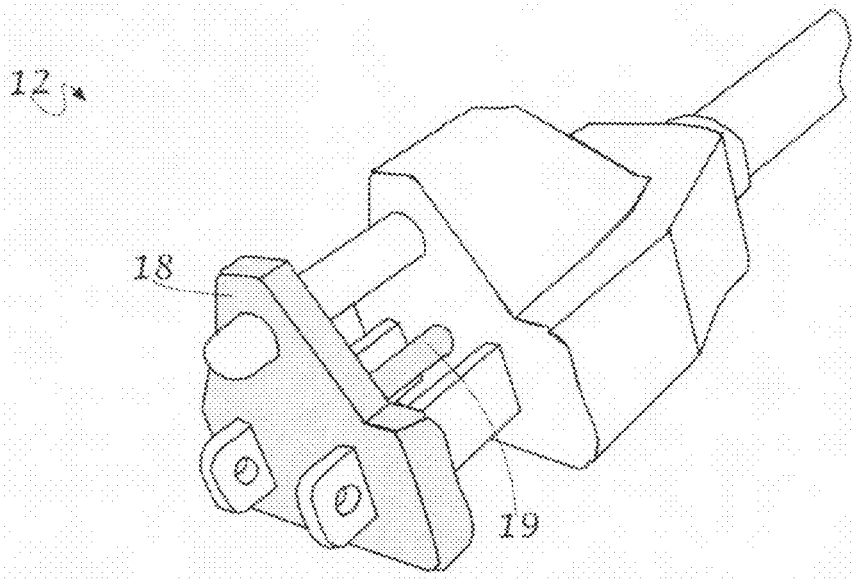
FIG. 3*b* shows a schematic of a perspective view of the plug in FIG. 3*a* with the brace element in a deployed position.

FIG. 3*a* shows a schematic of a three prong plug 12, configured according to another embodiment of the invention, comprising plug base 13, prongs 14, 15, and 16, electrical cord 17, and brace element 18. Brace element 18 is slidably attached to and integral with plug base 13. FIG. 3*b* shows a schematic of the three prong plug 12 of FIG. 3*a* with the sliding brace element 18 deployed to a position near the distal end of the prongs and bracing them against each other. Tether 19 limits the motion of the brace element and does not allow the brace element to slip off the prongs. FIG. 3*c* shows a schematic of an orthogonal end view of the brace element 18 of FIG. 3*a* and FIG. 3*b*. FIG. 3*d* shows a sectioned view of brace element 18 which comprises web-plate 20, tether 19 and stop 21 which keep the brace element 18 from slipping off the prongs.

Figure 3E:
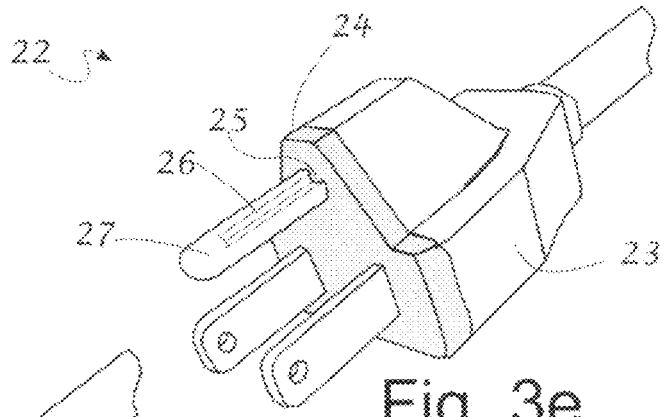
FIG. 3*e* shows a schematic of a perspective view of a three prong plug, configured according to a further embodiment of the invention, comprising a brace element with a protrusion that is received in a recessed channel along a prong.

FIG. 3*e* is a schematic showing a perspective view of a plug 22, with plug base 23 and brace element 24. Brace element 24 is integral with and slidably attached to the plug base 23. Brace element 24 comprises a protrusion 25 which is slideably received by channel 26 located along prong 27. Channel 26 extends along part of the length of prong 27. Any of the prongs may be configured to receive a protrusion attached to the brace element such that its motion is constrained.

Figure 3F:
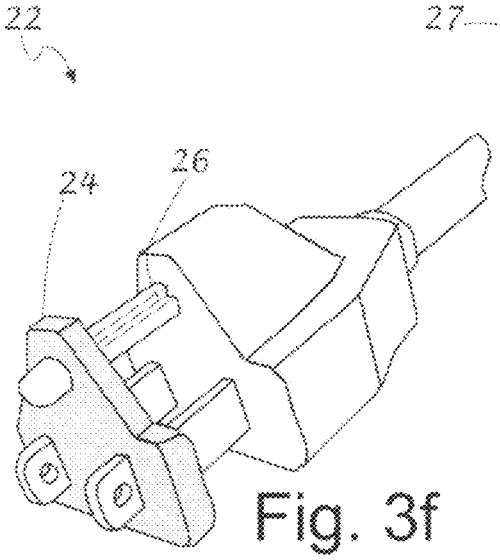
FIG. 3*f* shows a schematic of a perspective view of the plug in FIG. 3*e* wherein the brace element is in a fully deployed position.

FIG. 3*f* shows the plug 22 of FIG. 3*e* with the brace element 24 in a fully deployed position, where the protrusion 25 (not shown) has reached the distal end of channel 26.

The protrusion in FIG. 3*e* is preferably flexible so that it can be snapped into the channel during assembly.

Figure 3G:
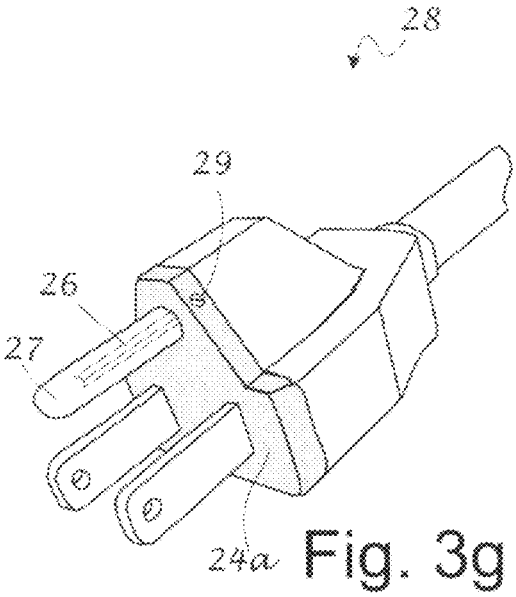
FIG. 3*g* shows a schematic of a perspective view of a three prong plug configured according to yet another embodiment of the invention comprising a brace element with a screw, the tip of which is received in a recessed channel along a prong.
Figure 3H:
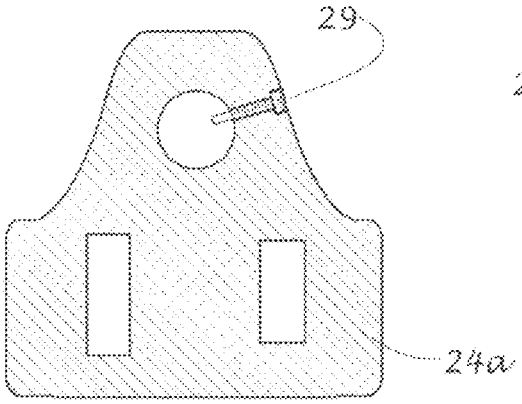
FIG. 3*h* shows a schematic of an orthogonal sectioned end view of the brace element in FIG. 3*g*.

Alternatively, FIG. 3*g* shows a plug 28 comprising brace element 24*a* and screw 29. The distal end of screw 29 is slidably engaged in channel 26. The extent to which the brace element 24*a* may be deployed is limited when the tip of screw 29 reaches the distal end of channel 26. FIG. 3*h* shows that the tip of screw 29 penetrates the opening in brace element 24*a* which receives prong 27 shown in FIG. 3*g*.

Figure 4A:
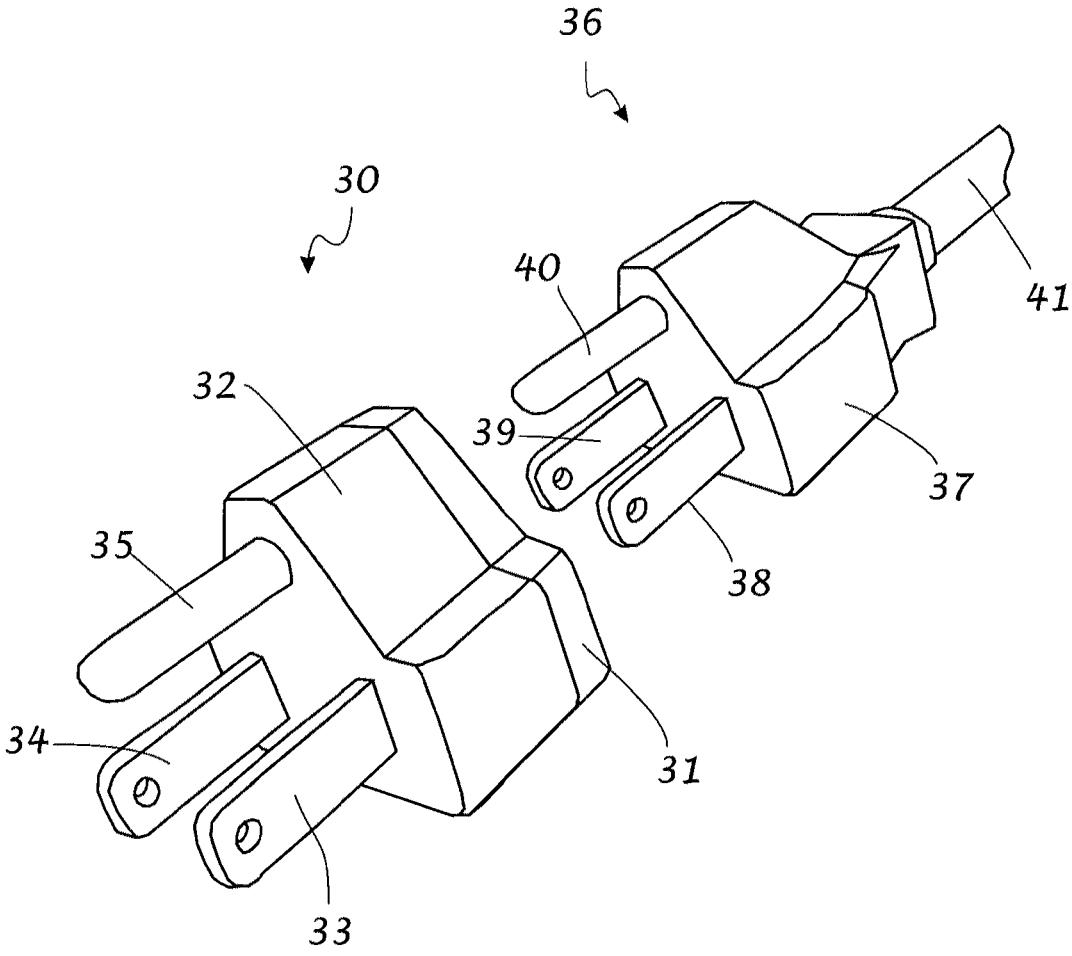
FIG. 4*a* shows a schematic of a perspective view of a three prong plug and plug adapter, configured according to still another embodiment of the invention, comprising a brace element in a retracted position.

FIG. 4*a* shows a schematic of a plug adapter 30, configured according to still another embodiment of the invention, comprising adapter base 31, brace element 32 and prongs 33, 34 and 35. Brace element 32 is slidably attached to and integral with adapter base 31. The brace element is shown in a fully retracted position. Also shown is a schematic of a conventional plug 36, plug base 37, prongs 38, 39, and 40, and cord 41. Not shown are receiving terminals of the plug adapter 30 which are configured to receive prongs 38, 39 and 40. When conventional plug 36 is plugged into plug adapter 30, prongs 33, 34, and 35 are electrically connected to prongs 38, 39 and 40 respectively. Brace element 32 may be deployed to shield and buttress prongs 33-35. The plug adapter prongs are configured to be received in a conventional receptacle designed to receive the prongs of conventional plug 36.

Figure 4B:
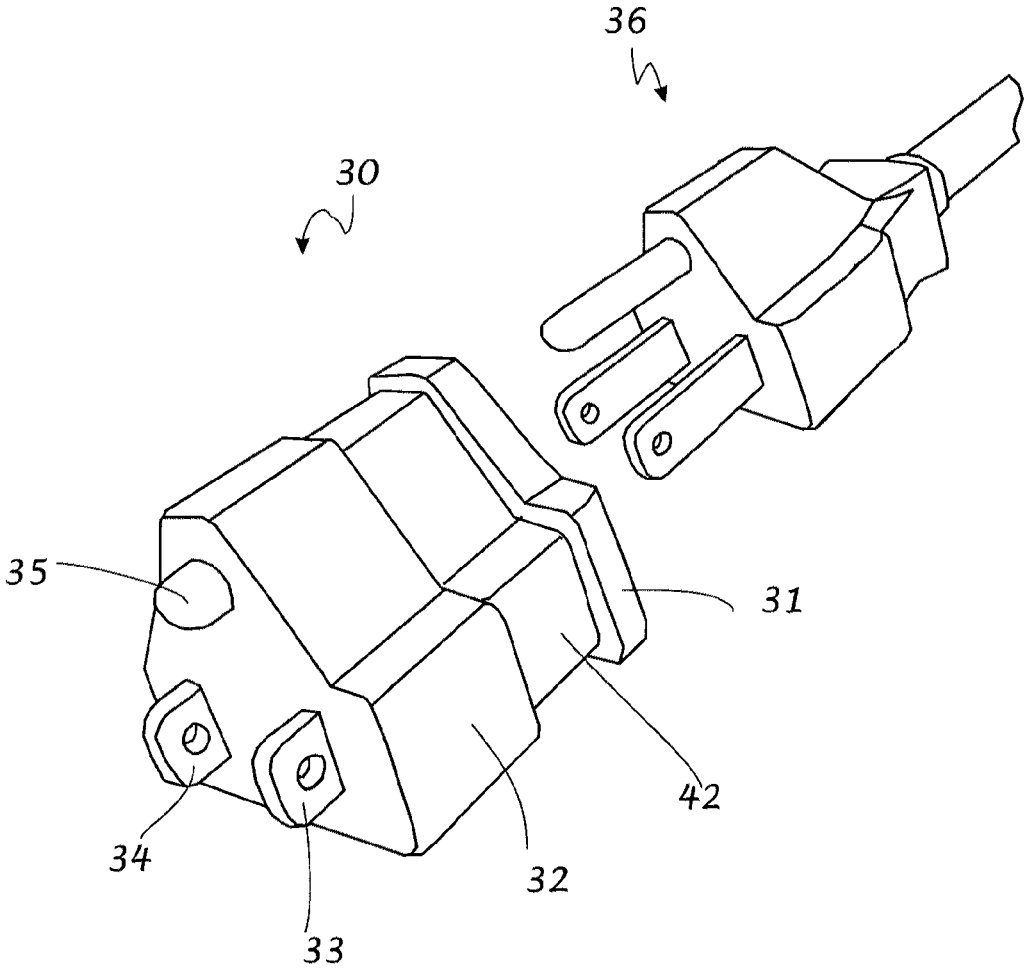
FIG. 4*b* shows a schematic of the plug and plug adapter of FIG. 4*a* with a brace element in a deployed position supporting, buttressing and shielding the three prongs of the adapter.

FIG. 4*b* shows a schematic of the conventional plug 36 and plug adapter 30 of FIG. 4*a*, wherein the brace element 32 has been deployed. Exposed portion 42 of the adapter base 31 is hidden by the cylindrical portion of brace element 32 when it is fully retracted. With the sliding brace element deployed, prongs 33, 34 and 35 are shielded and the space between the prongs is filled, by a portion of the web-plate, such that the prongs are also braced against lateral deforming or crushing forces. The brace element is slidably attached to the adapter base. The exemplary embodiment of the brace element shown in FIGS. 4*a* and 4*b* is configured to operate with two flat blade shaped prongs and a prong that is shaped substantially as a circular cylinder. However, the brace element may be configured to operate with any number of prongs or prongs of any shape and size.

Figure 5A:
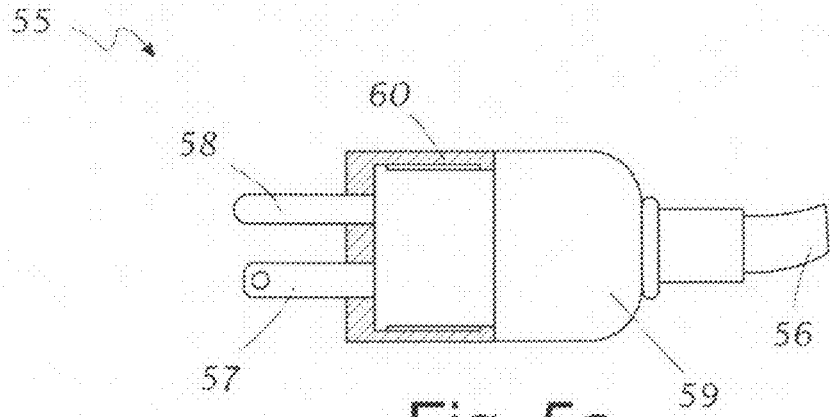
FIG. 5*a* shows a schematic of a plug configured according to a further embodiment of the invention. The brace element is shown in section in a fully retracted position. The brace element is slidably attached to the plug base.
Figure 5B:
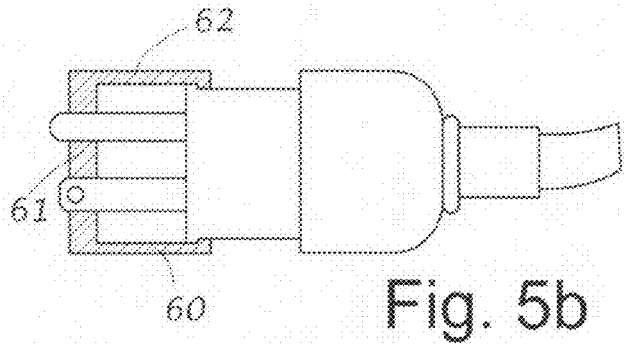
FIG. 5*b* shows a schematic of the plug in FIG. 5*a* where the brace element has been deployed fully to support, buttress and shield the prongs. The brace element is slidably attached to the plug base.

FIG. 5*a* shows a schematic of a three prong plug 55 configured according to a further embodiment of the invention. Conductors (not shown) in electrical cord 56 are electrically connected to prongs 57 and 58 and to a third prong which is not shown. The plug base 59 is typically fabricated substantially from an insulating material such as an injection molded plastic. In FIG. 5*a*, brace element 60 is shown in a fully retracted position and in section. FIG. 5*b* shows a schematic of the plug in FIG. 5*a* with the brace element 60, comprising cylindrical section 62 and web-plate 61, in a fully deployed position. In the deployed position, the terminals are shielded and also supported near their tips by the web-plate 61 of the brace element 60. Brace element 60 is slidably attached to an integral with plug base 59.

Figure 5C:
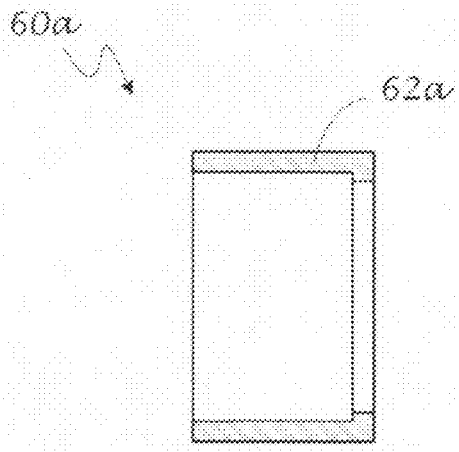
FIG. 5*c* shows a schematic of another brace element without a web-plate configured according to an aspect of an embodiment of the invention.
Figure 5D:
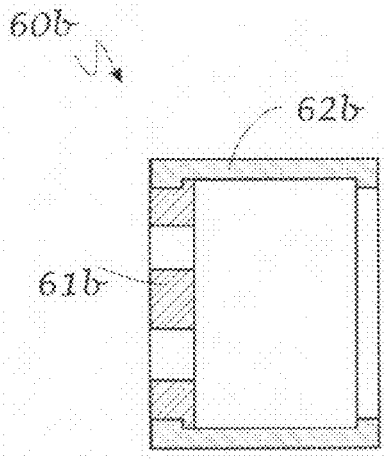
FIG. 5*d* shows a schematic of a brace element configured according to an aspect of an embodiment of the invention. The brace element is shown in section, comprising multiple distinct pieces that may be made of various materials. The brace element is a unitary assembly of multiple pieces that is slidably attached to the plug base.

Shield 60*a*, a schematic of which is shown in FIG. 5*c*, may be configured with a cylindrical piece 62*a* that is substantially open at both ends. In such a configuration, the deployed shield 60*a* protects the prongs but would not contact or support the prongs directly. A brace element may be fabricated as a single piece or as an assembly of multiple pieces. FIG. 5*d* shows a brace element 60*b* which comprises a substantially cylindrical piece 62*b* and a web-plate 61*b*. The cylindrical piece may be constructed from, for example, a metal such as steel, while web-plate 61*b* may be fabricated from, for example, a plastic material.

Figure 5E:
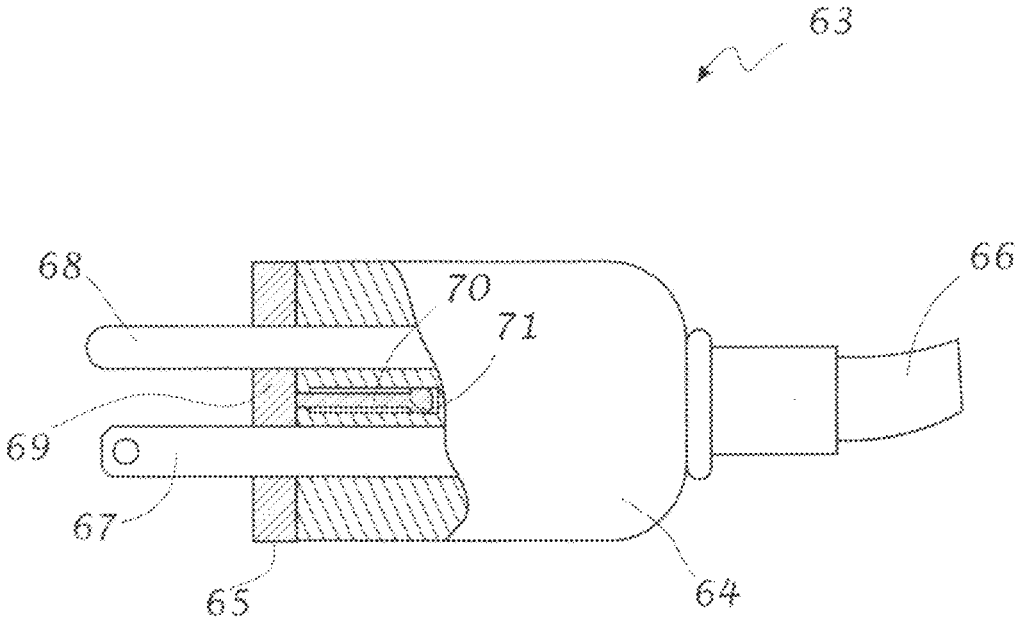
FIG. 5*e* shows a schematic of an orthogonal side view of a plug in partial section with a brace element configured, according to a still further embodiment of the invention.
Figure 5F:
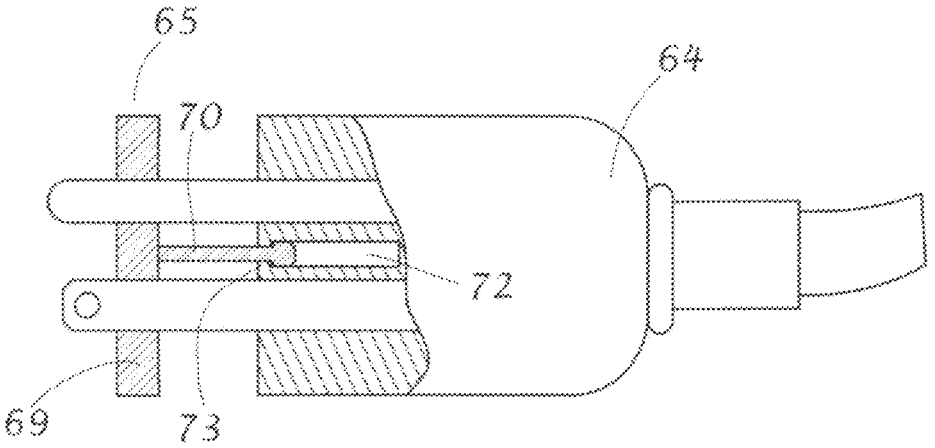
FIG. 5*f* shows a schematic of the plug in FIG. 5*d* where the brace element has been deployed fully to buttress the prongs.

The schematic in FIG. 5*e* shows a three prong plug 63, comprising a plug base 64 and a brace element 65, configured according to a still further embodiment of the invention. Brace element 65 is slidably attached to and integral with plug base 64. The brace element and plug base are shown in section and partial section respectively. Conductors (not shown) in electrical cord 66 are electrically connected to prongs 67 and 68 and to a third prong which is also not shown. In FIG. 5*e*, the brace element 65, which is in a fully retracted position, comprises a web-plate 69, a tether 70, and a stop 71. FIG. 5*f* shows a schematic of the plug in FIG. 5*e* with the brace element 65 in a fully deployed position. In this position, each of the prongs is supported both at its base end as well as being buttressed near its tip by the web-plate 69. The cavity 72 in plug base 64 is configured to accept tether 70 and stop 71. The opening 73 of the cavity and stop 71 are configured such that the stop 71 may be forced into the cavity during assembly of the plug, but once inside be securely retained therein. The tether 70 and stop 71 of the brace element work in conjunction with the cavity opening 73 to stop the brace element from being deployed beyond the end of the prongs. The tether is preferably sufficiently rigid so that the brace element may be retracted by pushing the web-plate towards the plug base.

Figure 6A:
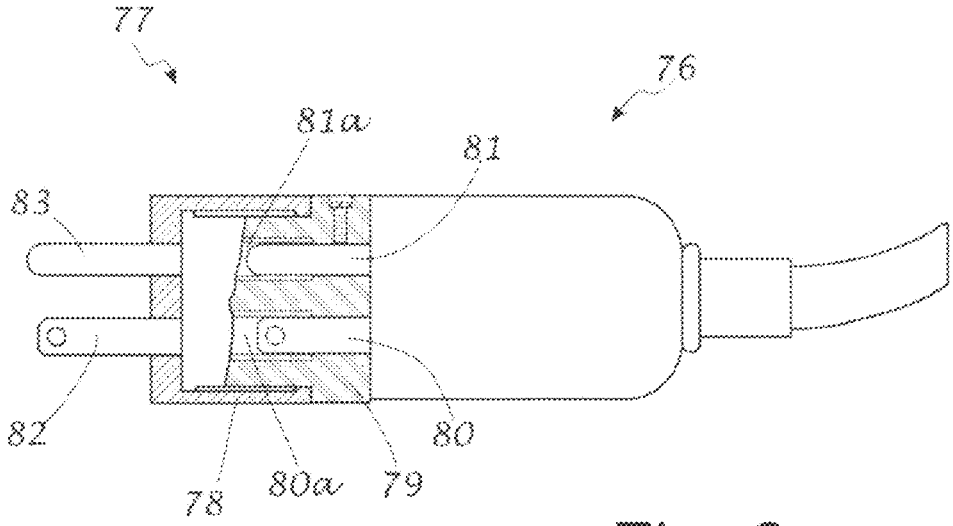
FIG. 6*a* shows a schematic of a plug and plug adapter, which comprises a brace element, configured according to still another embodiment of the invention. The brace element and the plug adapter base are shown in section and partial section respectively.

FIG. 6*a* is a schematic of a plug adapter 77 configured according to a further embodiment of the invention. Conventional plug 76 is coupled with and attached to a plug adapter 77. The brace element 78 and plug adapter base 79 are shown in section and partial section respectively. Brace element 78 is slidably attached to adapter base 79. The prongs 80 and 81 of the plug 76 are received in terminals 80*a* and 81*a* which are electrically connected to prongs 82 and 83 respectively, of the plug adapter 77.

Figure 6B:
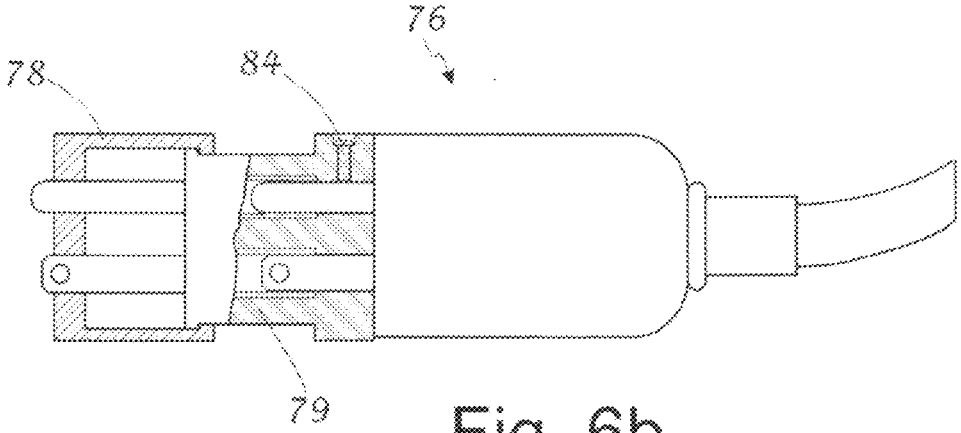
FIG. 6*b* shows a schematic of the plug and plug adapter of FIG. 6*a* with the brace element deployed fully to support, buttress and shield the prongs of the plug adapter. The brace element is slidably attached to the adapter base.

FIG. 6*b* shows the plug and plug adapter of FIG. 6*a* with the brace element in a fully deployed position. In FIG. 6*b*, a set screw 84 is used to bind the plug adapter base 79 to plug 76. It is preferred that plug adapter 77 in FIG. 6*a* be configured such that there is a substantially smooth transition between the outer dimensions of plug base 76 and the outer dimensions of brace element 78 when it is fully retracted. This will reduce possible interference among multiple plugs that are plugged into adjacent receptacles and help avoid points of stress concentration in the brace element when the plug is, for example, stepped on or otherwise exposed to crushing forces.

Figure 7A:
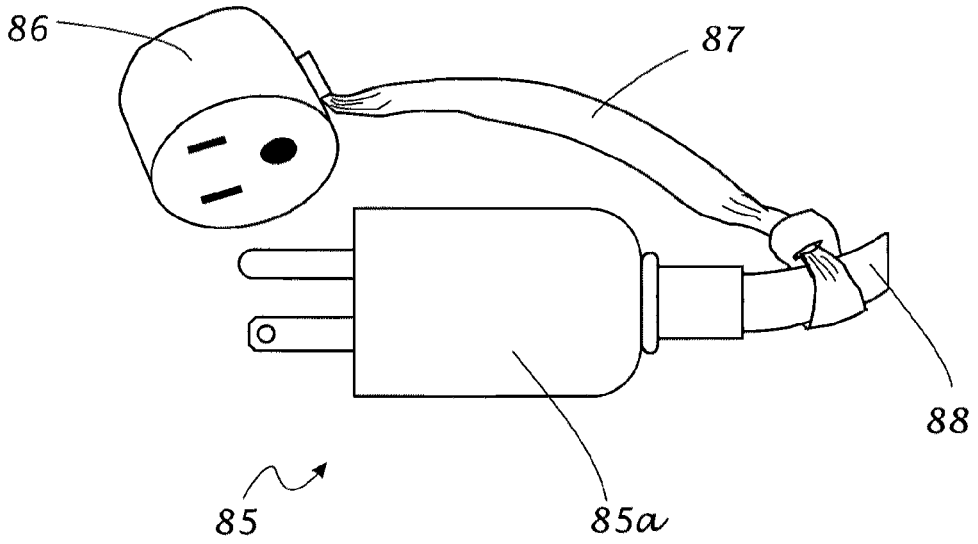
FIG. 7*a* shows a schematic of a plug and a dummy receptacle configured according to yet another embodiment of the invention. The dummy receptacle is attached to the cord at a point in close proximity to the plug base.

FIG. 7*a* shows a schematic of yet another embodiment configured according to the invention. A dummy receptacle 86, a brace element that is not an integral part of the plug base 85*a*, is configured so it may be attached to the end of the power cord 88 in close proximity to the plug base by means of strap 87. Strap 87 is preferably made of an elastic material.

Figure 7B:
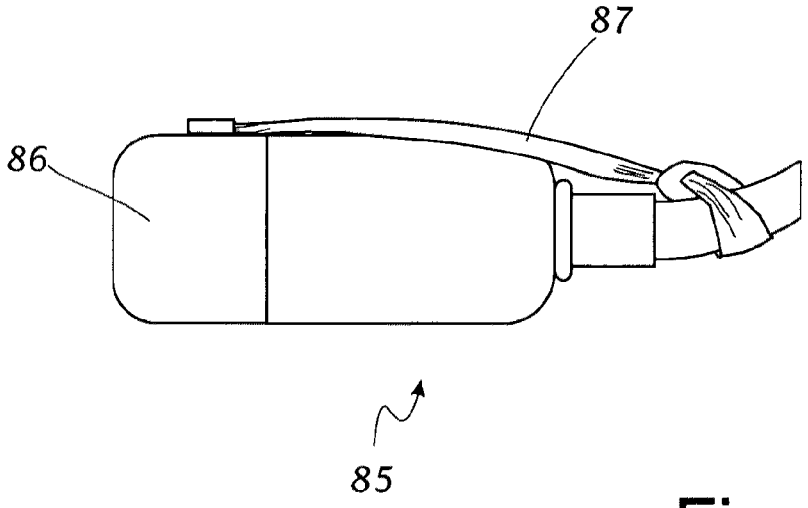
FIG. 7*b* shows a schematic of the plug and the dummy receptacle of FIG. 7*a* with the plug plugged into the dummy receptacle.

FIG. 7*b* shows the plug 85 of FIG. 7*a* plugged into the dummy receptacle 86, wherein the prongs of the plug are braced and protected from crushing forces. The band 87 is configured so that the dummy receptacle will not interfere with the normal use of the plug with conventional outlets, receptacles or power strips, especially where several receptacles are used in close proximity to each other. Preferably the dummy receptacle is configured so that the prongs of the plug fit snugly into the receptacle holes so that the prongs are supported against crushing transverse forces along their entire lengths.

Figure 7C:
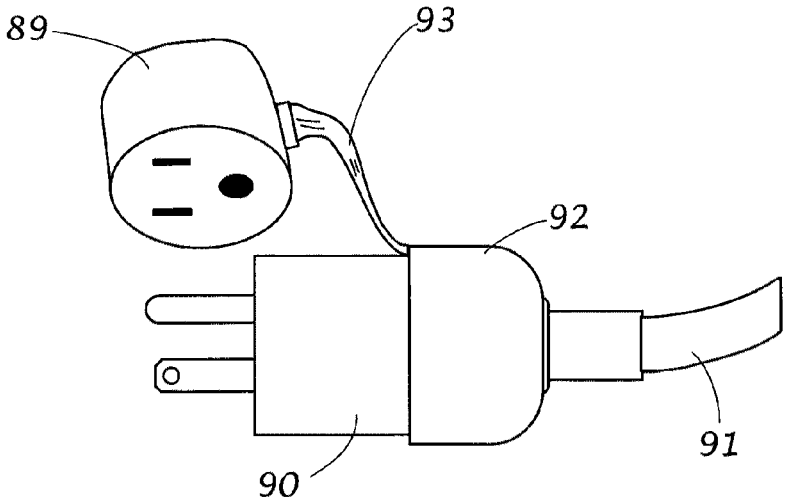
FIG. 7*c* shows a schematic of a plug and a dummy receptacle configured according to still another embodiment of the invention. The dummy receptacle is attached to the plug by means that includes a sleeve.
Figure 7D:
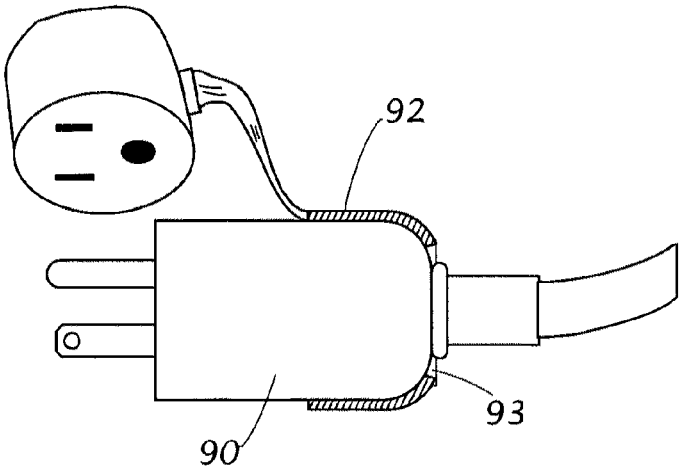
FIG. 7*d* shows a schematic of the plug and the dummy receptacle of FIG. 7*c* with the sleeve shown in section.

FIG. 7*c* shows a schematic of still another embodiment according to the invention wherein dummy receptacle 89 is configured so that it may be attached to plug base 90 located at the end of an electric cord 91. Sleeve 92 and strap 93 are used to flexibly attach the dummy receptacle 89 to plug base 90. FIG. 7*d* is a schematic showing the plug and dummy receptacle of FIG. 7*c* where sleeve 92 is in section. It is preferred that sleeve 92 be made of a stretchable material so that opening 93 of the sleeve may be stretched sufficiently to allow plug base 90 to pass through. The sleeve may be bound to the plug base 90 by stretching it over the plug base and then releasing it so that the plug base may be securely gripped by the sleeve. Alternatively, the dummy receptacle may be attached to an electric cord or a plug by using, for example, screws, bolts, adhesives, Velcro straps, or collars.

Figure 7E:
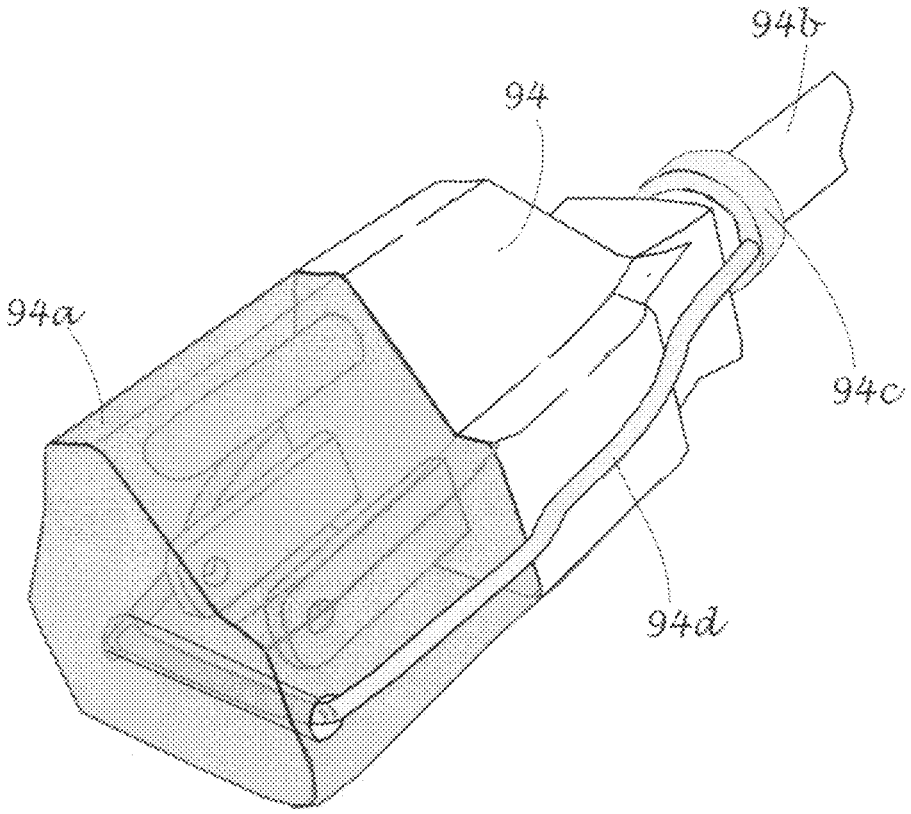
FIG. 7*e* shows a schematic of a plug and dummy receptacle configured according to yet another embodiment of the invention.

FIG. 7*e* shows a schematic of yet another embodiment configured according to the invention wherein the prongs of conventional plug 94 are plugged into and supported, braced and shielded by brace element 94*a*. The brace element 94*a* is flexibly attached to cord 94*b* by collar 94*c* and lanyard 94*d*. The collar 94*c* may be a split collar that is configured to slide freely along the cord 94*b*.

Figure 8A:
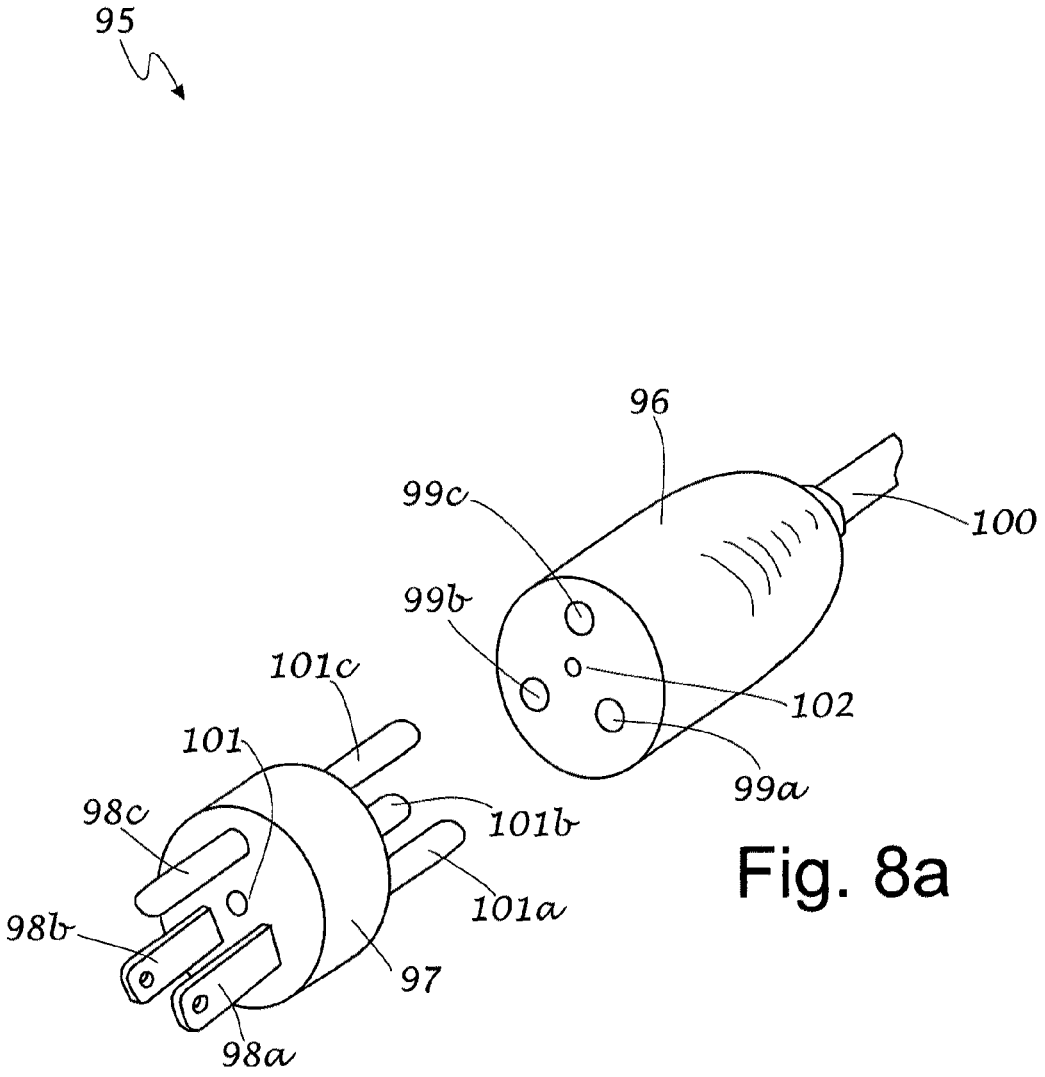
FIG. 8*a* shows a schematic of a perspective view of a two piece three prong plug, comprising a plug base and a prong assembly, configured according to a further embodiment of the invention.

FIG. 8*a* shows a schematic of a two piece electric plug 95 configured according to a further embodiment of the invention which comprises a plug base 96 and a removable prong assembly 97. If damaged, the prong assembly, which comprises three prongs 98*a*, 98*b* and 98*c*, may be readily separated from the plug base and replaced. Plug base 96 also comprises three receiving terminals 99*a*, 99*b* and 99*c*, each of which is electrically connected to a separate conductor (not shown) in cord 100. These connections are preferably encapsulated in a plastic material by injection molding. Alternatively, the plug base may be constructed in one or more pieces wherein the connections are encased in one or more materials, such as for example, plastics, ceramics, bakelite, or various metals. Each of the receiving terminals 99*a*, 99*b* and 99*c* of the plug base is configured and positioned to receive one of the corresponding protruding electrical contacts or terminals 101*a*, 101*b*, or 101*c* of the prong assembly 97 when the constituent pieces of the plug are assembled. Each of contacts or terminals 101*a*, 101*b* and 101*c* is electrically conductively connected to prongs 98*a*, 98*b* or 98*c* respectively. It is preferred that the prong assembly be fabricated using injection molding. A fastening screw (not shown) may be used to secure prong assembly 97 to plug base 96. Hole 101 and threaded hole 102 are configured to receive such a fastening screw. It is preferred that, when assembled, the two piece plug 95 be no larger than a conventional plug.

Figure 8B:
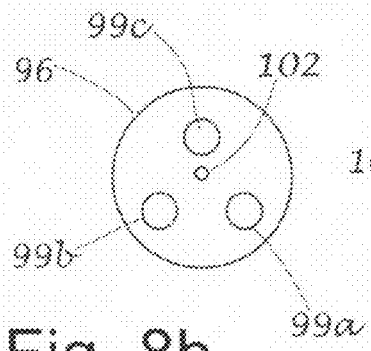
FIG. 8*b* shows a schematic of an orthogonal end view of the plug base shown in FIG. 8*a*.
Figure 8C:
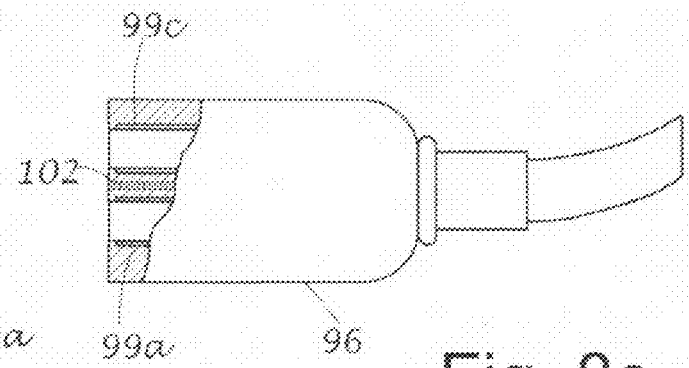
FIG. 8*c* shows a schematic of an orthogonal side view, shown in partial section, of the plug base shown in FIG. 8*a*.
Figure 8D:
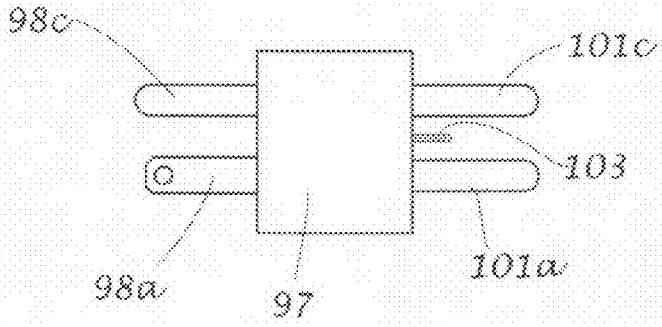
FIG. 8*d* shows a schematic of an orthogonal side view of the prong assembly shown in FIG. 8*a*.
Figure 8E:
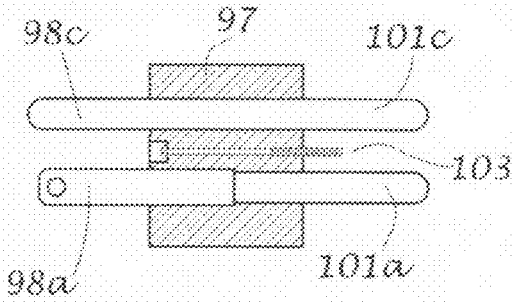
FIG. 8*e* shows a schematic of an orthogonal side view, shown in section, of the prong assembly shown in FIG. 8*a*.

FIG. 8*b* and FIG. 8*c* show orthogonal schematic views of the plug base of the two piece plug 95 shown in perspective in FIG. 8*a*. FIG. 8*c*, in partial section, shows receiving terminals 99*a* and 99*c* and threaded hole 102. FIG. 8*d* shows an orthogonal schematic side view of the prong assembly 97 and a portion of screw 103 for attaching prong assembly 97 to plug base 96. FIG. 8*e* shows an orthogonal schematic sectioned side view of the prong assembly 97. Each of the prongs and contacts of the prong assembly shown in FIG. 8*e* may be made as multiple pieces that are electrically connected, such as prong 98*a* and contact 101*a* or as single piece conductors, such as prong 98*c* and contact 101*c*. The electrical contacts 101*a*, 101*b*, or 101*c* may be of any convenient size, shape, orientation or position that can be received by corresponding receiving terminals 99*a*, 99*b* and 99*c* of the plug base. Fastening screw 103 may be used to secure the prong assembly 97 to the plug base 96.

Figure 9A:
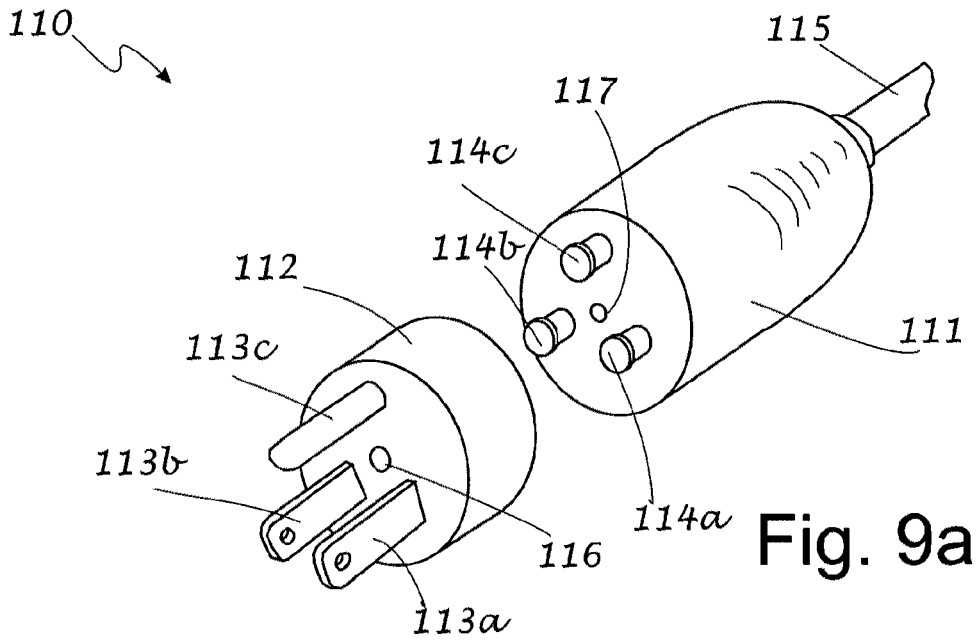
FIG. 9*a* shows a schematic of a perspective view of a two piece three prong plug, comprising a plug base and a prong assembly, configured according to a yet further embodiment of the invention.

FIG. 9*a* shows a schematic of a two piece plug 110 configured according to a still further embodiment of the invention. Two piece electric plug 110 comprises a plug base 111 and removable prong assembly 112. The removable prong assembly, which comprises three prongs 113*a*, 113*b* and 113*c* may be readily removed, discarded and replaced if damaged. Plug base 111 comprises three terminals 114*a*, 114*b* and 114*c* each of which is electrically connected to a conductor (not shown) in cord 115. These connections are preferably encapsulated in a plastic material by injection molding. Alternatively, the plug base may be constructed in one or more pieces such that the connections are encased in one or more materials, such as, for example, plastics, ceramics, bakelite, or various metals. Each of the three terminals 114*a*, 114*b* and 114*c* is configured and positioned to electrically connect to a corresponding electrical contact (not shown) on the prong assembly. Each such contact of the prong assembly is electrically conductively connected to one of the prongs 113*a*, 113*b* and 113*c*. A fastening screw (not shown) may be used to secure prong assembly 112 to plug base 111. Hole 116 and threaded hole 117 are configured to receive such a fastening screw.

Figure 9B:
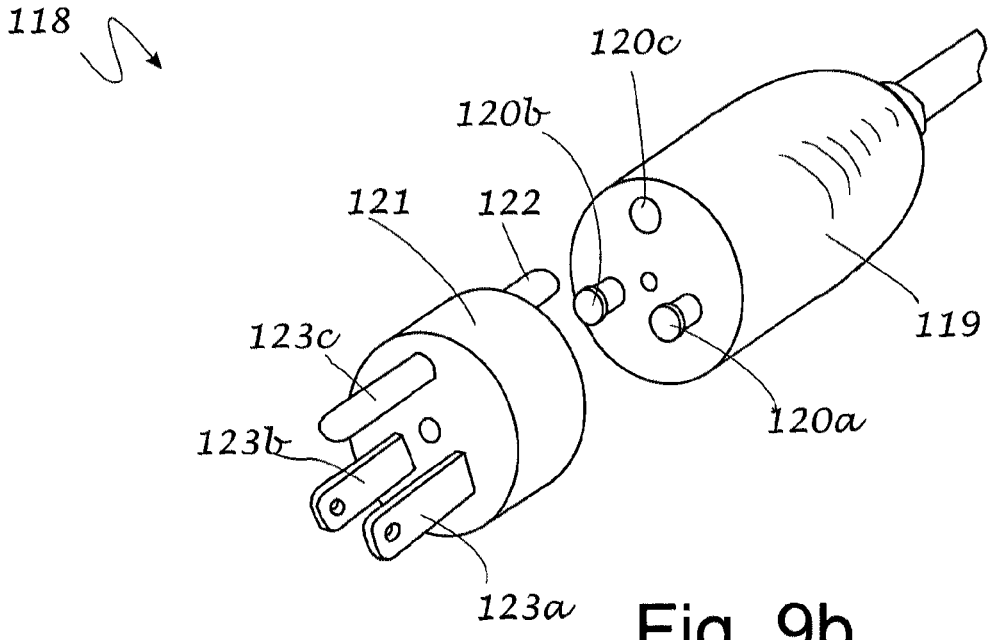
FIG. 9*b* shows a schematic of a perspective view of a two piece three prong plug, comprising a plug base and a prong assembly, configured according to a still further embodiment of the invention.

The electrical terminals 114*a*, 114*b* and 114*c* shown in FIG. 9*a* are protruding terminals. The corresponding contacts on the prong assembly would preferably be receiving terminals. FIG. 9*b* shows a schematic of a two piece plug 118 wherein the plug base 119 comprises two protruding electrical terminals 120*a* and 120*b* and one receiving terminal 120*c*. The prong assembly 121 comprises one protruding terminal 122 and two receiving terminals (not shown), and prongs 123*a*, 123*b* and 123*c*.

Figure 9C:
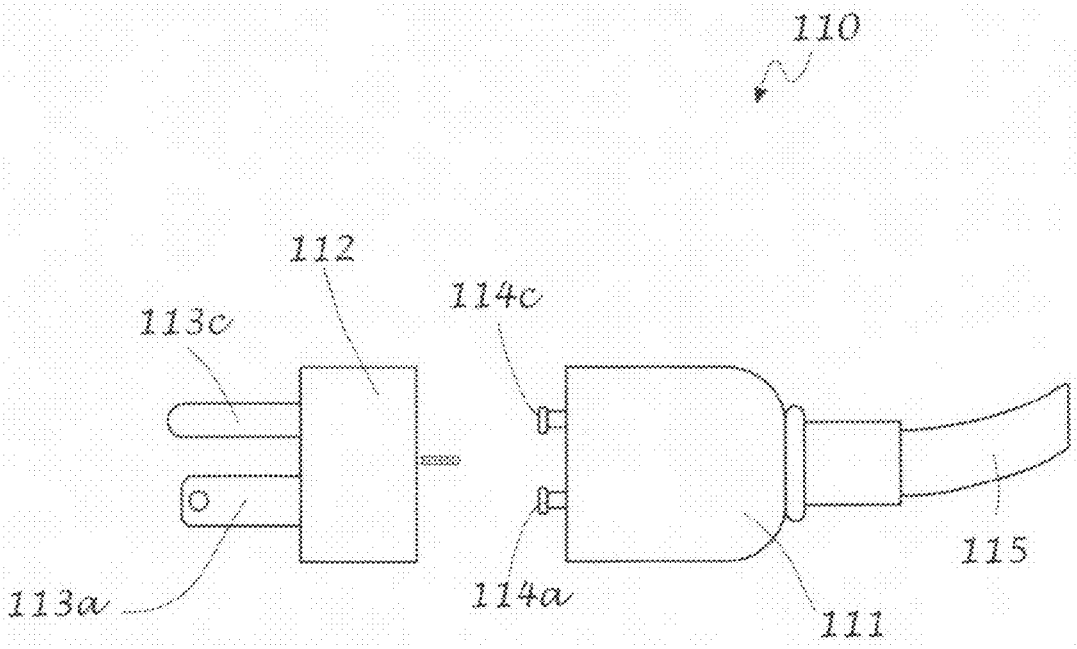
FIG. 9*c* shows a schematic of an orthogonal side view of the two piece plug shown in FIG. 9*a*.
Figure 9D:
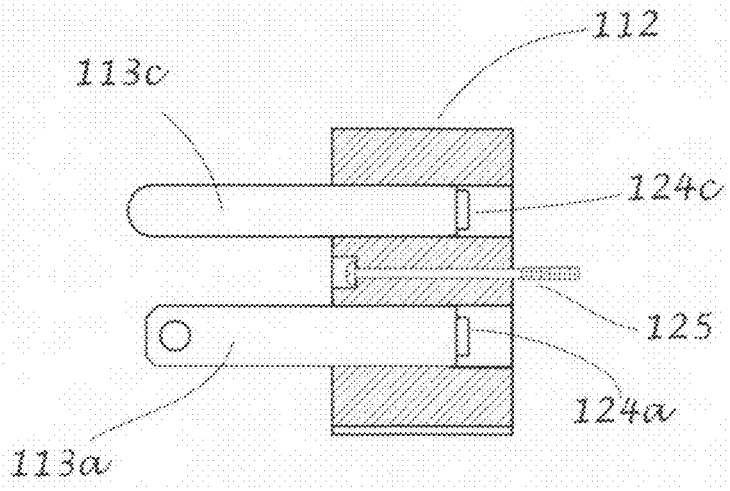
FIG. 9*d* shows a schematic of an orthogonal side view, in section, of the prong assembly shown in FIG. 9*a*.

FIG. 9*c* shows an orthogonal schematic view of the two piece plug 110, shown in perspective in FIG. 9*a*, comprising plug base 111 and prong assembly 112. Also shown are two protruding terminals, 114*a* and 114*c*, of plug base 111. FIG. 9*d* shows a sectioned view of the prong assembly 112, which comprises receiving terminals 124*a* and 124*c* electrically connected to prongs 113*a* and 113*c* respectively. The third receiving terminal of prong assembly 112 is not shown in FIG. 9*d*.

The plug base 111 is preferably manufactured from plastic by injection molding. Base 111 is attached to an electric cord 115 which comprises three electrical conductors (not shown). Each of the three electrical contacts 114*a*, 114*b* and 114*c*, is electrically conductively connected to a corresponding electrical conductor in the cord 115.

Figure 9E:
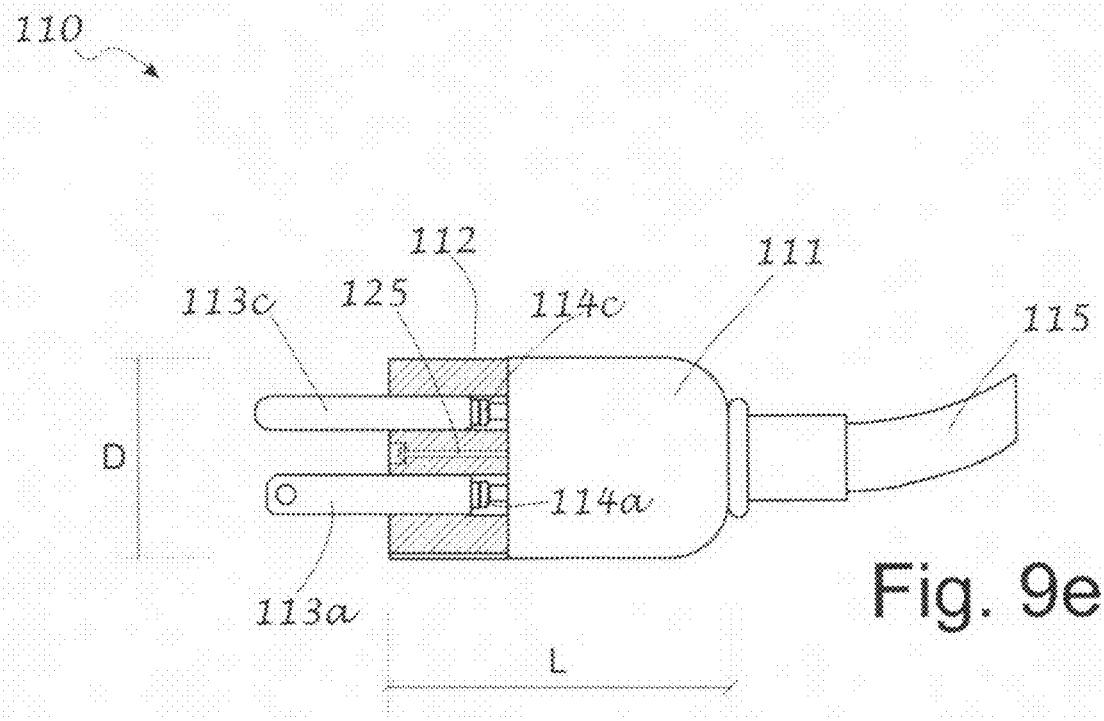
FIG. 9*e* shows a schematic of an orthogonal side view, in partial section, of the two piece plug in FIG. 9*a* with the two pieces attached to each other.

FIG. 9*e* shows an orthogonal side view of the assembled two piece plug 110 of FIG. 9*a*, comprising plug base 111 and prong assembly 112. Prongs 113*a*, 113*b* (not shown) and 113*c* are electrically connected to terminals 114*a*, 114*b* (not shown) and 114*c* of the plug base respectively. The prongs 113*a*, 113*b* (not shown) and 113*c* in the plug 110 as assembled are electrically conductively connected to conductors (not shown) in cord 115. If the prongs of plug 110 are damaged, prong assembly may be readily replaced.

It is preferred that the two piece electric plug 111 be substantially no larger in size than a conventional injection molded plug. For example, it is preferred that a NEMA5-15 two piece electric plug, such as shown in FIG. 9*e*, be no larger than approximately 1.25 inches in diameter (Dimension D) and have an overall length of no more than 1.5 inches (Dimension L).

Figure 9F:
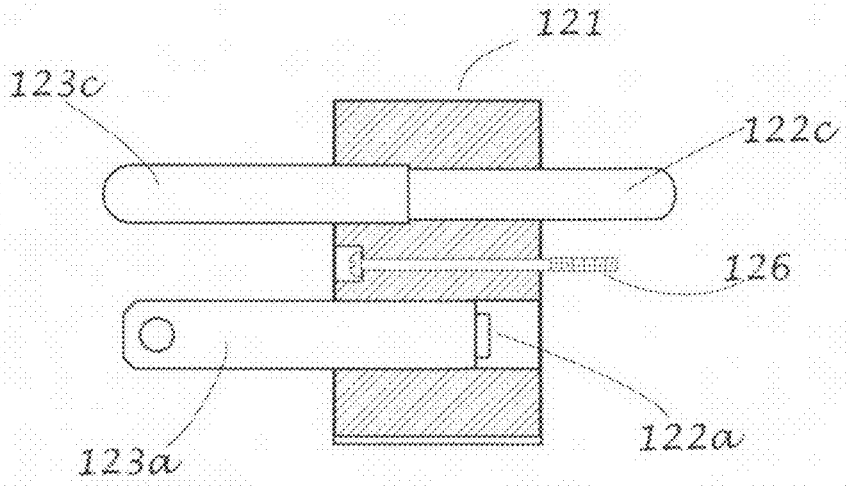
FIG. 9*f* shows a schematic of an orthogonal side view, in section, of the prong assembly shown in FIG. 9*b*.

FIG. 9*f* shows a schematic side view (in section) of prong assembly 121 shown in FIG. 9*b*. Prong assembly 121 comprises prongs 123*a* and 123*c* which are electrically connected to receiving terminal 122*a* and protruding terminal 122*c*. For safety, it is preferred that terminals of the prong assembly, that in use may achieve elevated voltage, for example, in excess of 12 volts AC or DC, be receiving terminals. It is further preferred that prong assembly terminal that in use is a ground terminal be protruding so as to help to align and secure the prong assembly to the plug base.

Figure 10B:
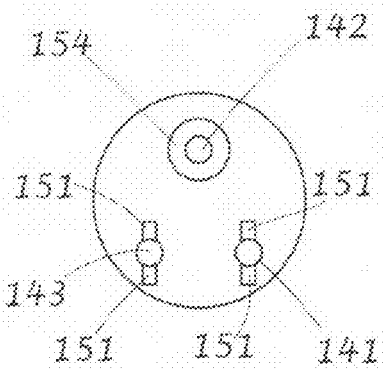
FIG. 10 shows a schematic of a plug with individually removable prongs configured according to another embodiment of the invention.
Figure 10A:
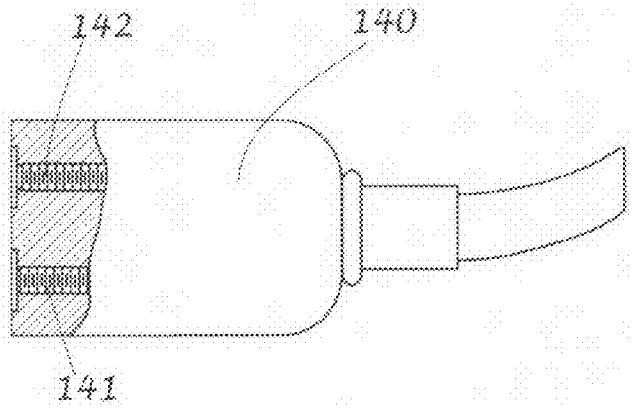
Figure 10C:
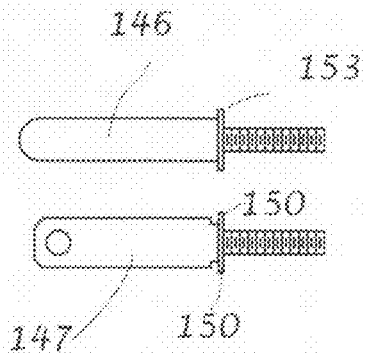

FIG. 10*a* shows yet a further embodiment configured according to the invention. Electrical plug base 140 is configured with threaded holes 141 and 142. Prongs 146 and 147 are individually removably attached to the plug base 140 by means of threaded holes 141 and 142. End views of three threaded holes 141, 142 and 143 of the plug are shown in FIG. 10*b*. The flat prong 147 in FIG. 10*c* has alignment or positioning tabs 150 that snap in place in recesses 151. The prong 146 in FIG. 10*c*, which is substantially a circular cylinder, has a flange 153 that fits in recess 154. With this configuration, the prongs can be replaced readily if they are bent or damaged. It is preferred that the plug base 140 be fabricated by injection molding.

Figure 11:
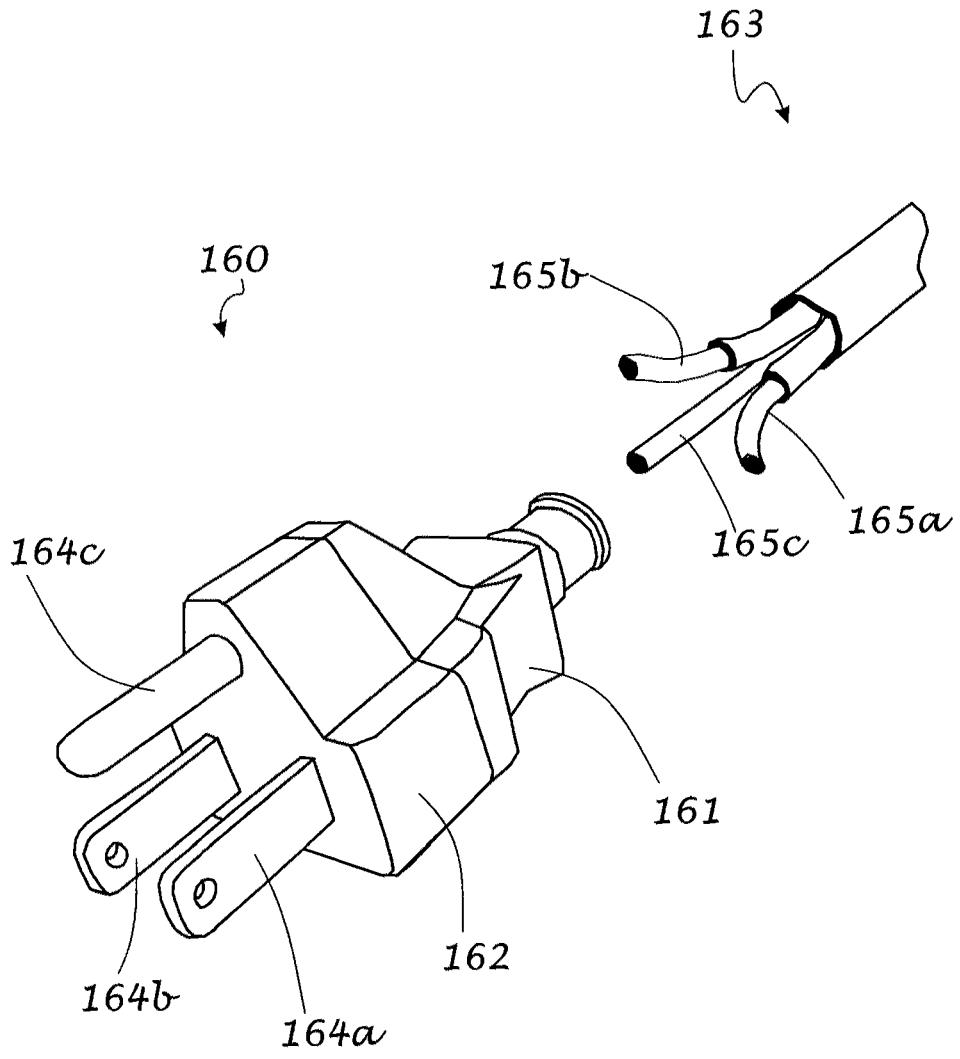
FIG. 11 shows a schematic of a replacement plug comprising a brace element configured according to a further embodiment of the invention.

FIG. 11 shows a schematic of a three prong replacement plug 160 configured according to still a further embodiment of the invention comprising plug base 161 and brace element 162. Plug 160 is configured to accept a three conductor cord 163 such that prongs 164*a*, 164*b* and 164*c* may be electrically conductively connected to conductors 165*a*, 165*b* and 165*c* respectively.

Figure 12A:
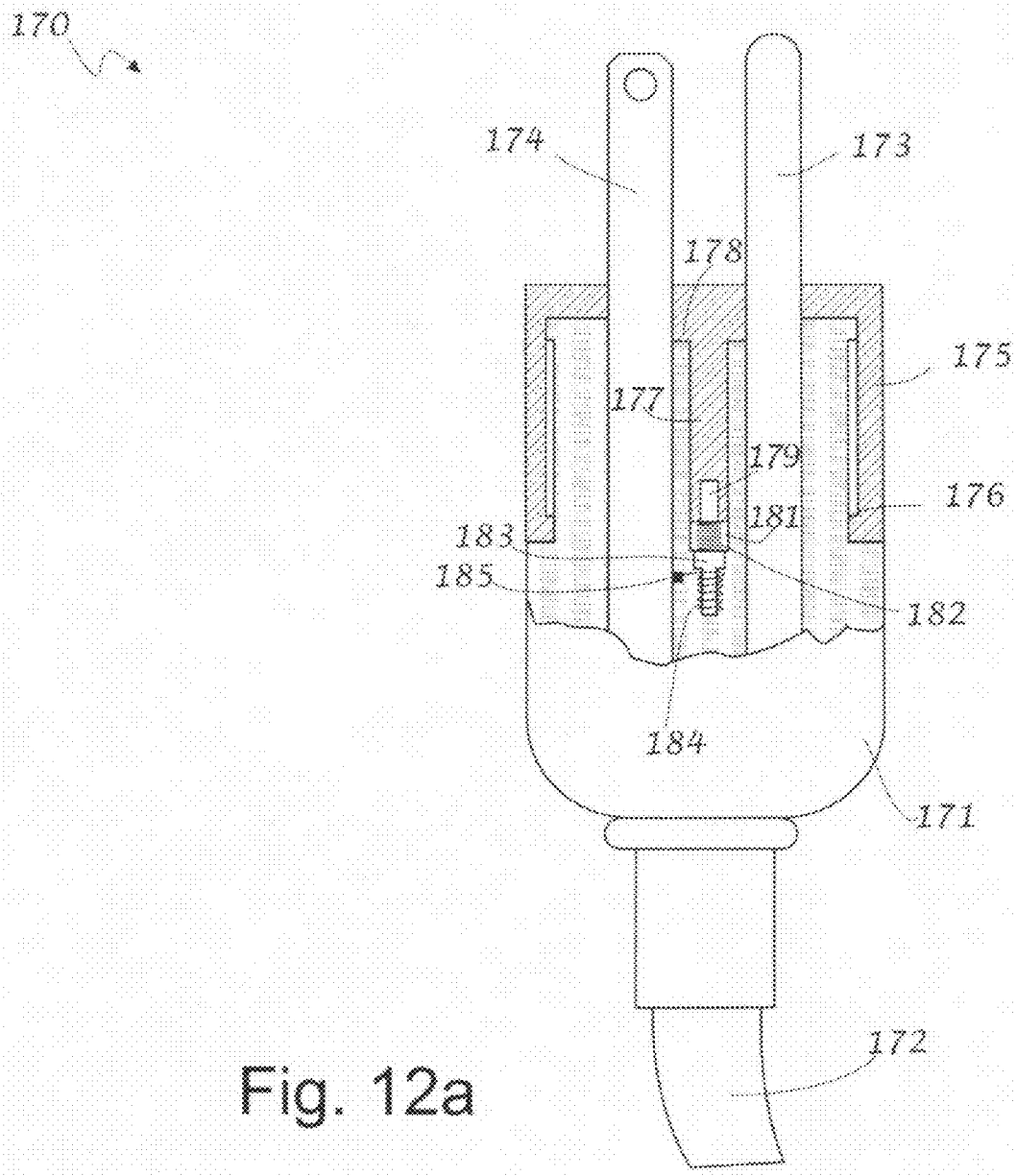
FIG. 12*a* shows a schematic of the orthogonal view of a plug configured according to yet another embodiment of the invention. The brace element (in fully retracted position) and plug base are shown in section and partial section respectively.

FIG. 12*a* shows a schematic of a three prong (two of which are shown) plug configured according to yet another embodiment of the invention. Plug 110 comprises plug base 171, cord 172, ground prong 173, line voltage prong 174, neutral prong (not shown), and retracted brace element 175. It is configured so that the brace element may be deployed automatically. The brace element 175 comprises stop 176, actuator 177, which is preferably rigid, and protruding boss 178. The actuator has an insert 179 at its tip which is fabricated from a ferrous or ferromagnetic material or other materials that are attracted by a magnet.

The plug base 171 comprises a cavity 181 that is configured to receive actuator 177 and a cavity for receiving protruding boss 178. Cavity 181 also comprises a spring 182 which is compressed by the actuator 177 when the brace element is in a retracted position. The protruding boss 178 is configured to increase the rigidity of the portion of the web-plate that is interposed in between the prongs.

Figure 12B:
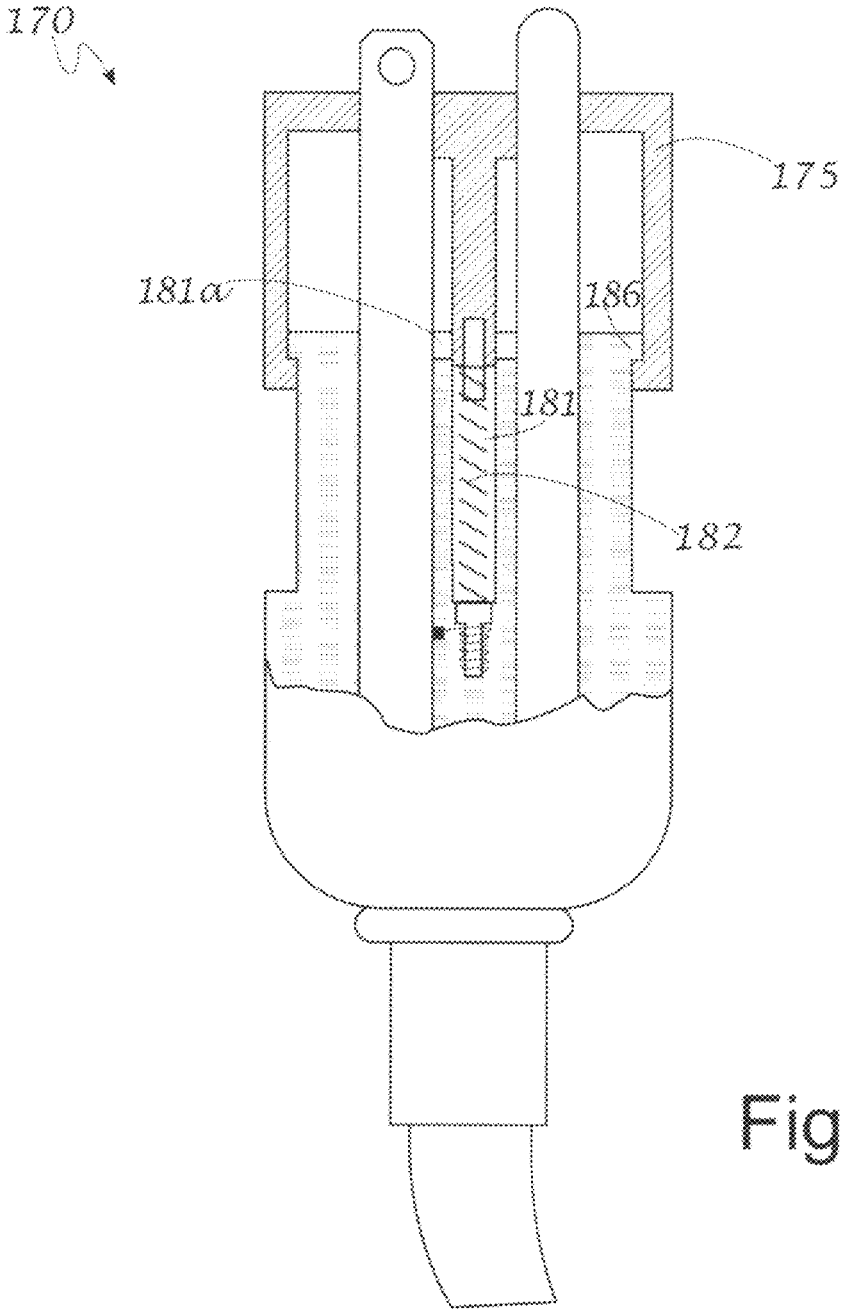
FIG. 12*b* shows a schematic of the plug in FIG. 12*a* with the brace element in deployed position.

The plug base 171 also comprises an electromagnet 183 that may be energized by coil 184. Coil 184 is connected to line voltage prong 174 by means of contact 185 and a neutral prong (contact for neutral prong not shown). The coil 184 is configured to draw a small fraction of the rated power of the plug when the prongs are engaged in a powered receptacle. When so energized, the current flowing through the coil causes the electromagnet 183 to become magnetized and attract insert 179 with sufficient force to overcome the force exerted by compressed spring 182 on the actuator. When the plug 170 is withdrawn from the receptacle, the current in coil 184 is interrupted and the magnetism of electromagnet 183 collapses allowing spring 182 to automatically deploy the brace element by forcing actuator 177 to move outwardly in cavity 181. It is preferred that the current draw of coil 184 be no greater than 1% of the rated current draw of the plug and more preferably no greater than 0.1% of the rated current draw of the plug. FIG. 12*b* shows plug 170 with brace element 175 in a fully deployed position. Spring 172 is extended. The outward motion of the brace element is interrupted when the stop 176 reaches radially outwardly protruding rim 186. Cavity 181*a* receives boss 178 when the brace element is retracted.

Figure 12C:
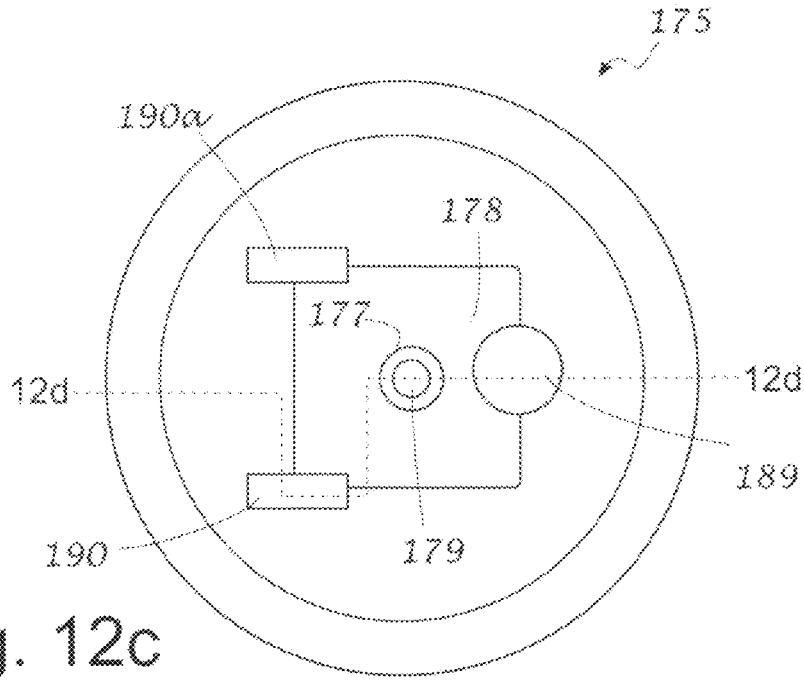
FIG. 12*c* shows an orthogonal end view schematic of the brace element shown in FIGS. 12*a* and 12*b*.

FIG. 12*c* shows the bottom orthogonal view of brace element 175 shown in FIGS. 12*a* and 12*b*. Openings 189 and 190 are sized to slidably receive prongs 173 and 174 shown in FIGS. 12*a* and 12*b*. Opening 190*a* is sized to slidably receive neutral prong (not shown).

Figure 12D:
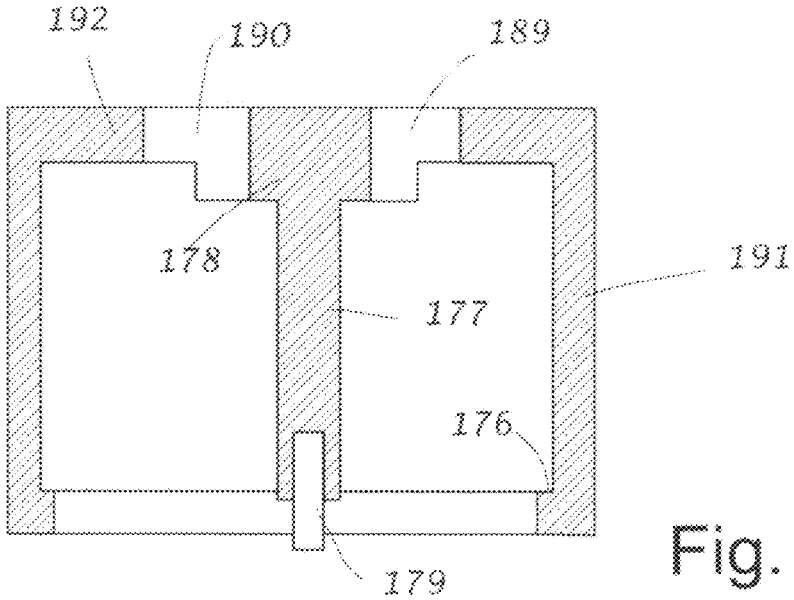
FIG. 12*d* shows a sectioned orthogonal side view of the brace element shown in FIGS. 12*a* and 12*b*.

FIG. 12*d* shows a side view sectioned schematic of the brace element 175 shown in FIGS. 12*a*, 12*b* and 12*c*. The brace element comprises actuator 177 and cylindrical section 191. The cylindrical section 191 connects stop 176 to web-plate 192. Actuator 177 is configured with insert 179 at its distal end. The portion of the web-plate located in between the prongs is augmented by protruding boss 178.

Several embodiments have been described herein, some with reference to accompanying figures. These are intended to be illustrative. The following claims are not limited to or by the described illustrative embodiments, figures, stated objects of the invention or the abstract. Furthermore, various presently unforeseen or unanticipated combinations of the disclosed embodiments, or their elements, or alternatives, variations or improvements which may become apparent to those of ordinary skill in the art are also intended to be encompassed by the following claims.

What is claimed is:

1. A multi-piece electrical power-cord plug comprising:

an electrical cord, with a first end and a second end, comprising at least a first electric conductor and a second electric conductor that are electrically mutually insulated;

a prong assembly comprising a first prong and a second prong, and a first receiving prong assembly terminal that is electrically conductively connected to the first prong and a second prong assembly terminal that is electrically conductively connected to the second prong, wherein the prongs are mutually electrically insulated and are constructed according to a NEMA plug standard;

a plug base, connected to the first end of the electrical cord, comprising a first protruding plug base terminal that is electrically conductively connected to the first conductor in the electrical cord and a second plug base terminal that is electrically conductively connected to the second conductor in the electrical cord, wherein the plug base terminals are not constructed according to the NEMA standard; and a nonpermanent attachment device;

wherein the plug base is immovably secured relative to the prong assembly by the attachment device, and wherein the first protruding plug base terminal is received in and in conductive electrical contact with the first receiving prong assembly terminal, and wherein the second plug base terminal is in conductive electrical contact with the second prong assembly terminal.

2. The plug according to claim 1 wherein the attachment device comprises a screw.

3. The plug according to claim 1 wherein the electrical cord includes a third electric conductor mutually insulated from the first and second conductors, and wherein plug base includes a third plug base terminal mutually insulated from the second and third plug base terminals and electrically conductively connected to the third electric conductor, and wherein the prong assembly includes a third prong and a third prong assembly terminal that are electrically conductively connected, and wherein the third prong assembly terminal and the third prong base terminal are in conductive electrical contact.

4. The plug according to claim 3 wherein all the plug base terminals are protruding terminals.

5. The plug according to claim 4 wherein the NEMA standard is the NEMA5-15 plug standard.

6. The plug according to claim 5 wherein the protruding length of the first plug base terminal is substantially shorter than the protruding length of the first prong.

7. The plug according to claim 5 wherein the multi-piece electrical power-cord plug is substantially no larger than a conventional NEMA 5-15 injection molded plug.

8. A method of constructing a multi-piece electrical power-cord plug, comprising:

selecting a NEMA plug standard;

providing an electrical power cord with a first end and a second end, comprising at least two conductors;

overmolding a prong assembly comprising at least two mutually insulated prongs constructed according to the NEMA plug standard and at least two receiving prong assembly terminals wherein each prong is electrically conductively connected to one prong assembly terminal;

overmolding a plug base comprising at least two mutually insulated protruding plug base terminals wherein each terminal is electrically conductively connected to a conductor at the first end of the electric cord, wherein at least one plug base terminal is not constructed according to the NEMA standard; and securing the prong assembly relative to the plug base by using a nonpermanent attachment mechanism to immovably secure the plug base relative to the prong assembly, wherein the receiving prong assembly terminals and the protruding plug base terminals are in electrical contact.

9. The method according to claim 8 wherein at least one protruding terminal of the plug base protrudes a distance that is substantially less than the protruding length of at least one prong.

10. A multi-piece electrical power-cord plug comprising:

a prong assembly comprising first, second, and third mutually electrically insulated prongs electrically conductively connected to first, second, and third prong assembly terminals respectively wherein at least the first prong assembly terminal is a receiving terminal;

a plug base attached to an electrical cord comprising first, second, and third plug base terminals, wherein at least the first plug base terminal is a protruding terminal; and a nonpermanent attachment device;

wherein the plug base is immovably secured relative to the prong assembly by the attachment device, and wherein the first plug base terminal is received in the first prong assembly terminal, and wherein the first, the second and the third plug base terminals are in electrically conductive contact with the first, the second and the third prong assembly terminals respectively, and wherein the protruding length of the first plug base terminal is substantially shorter than the first prong of the prong assembly.

11. The multi-piece electrical power-cord plug according to claim 10, wherein the attachment device comprises a screw.

12. The multi-piece electrical power-cord plug according to claim 11, wherein the prongs of the prong assembly are constructed according to a NEMA standard.

13. The multi-piece electrical power-cord plug according to claim 12, wherein the NEMA standard is a NEMA 5-15 plug standard.

14. The multi-piece electrical power-cord plug according to claim 13 wherein the multi-piece electrical power-cord plug is constructed to be substantially no larger in size than a conventional injection molded plug.

15. The multi-piece electrical power-cord plug according to claim 14, wherein the plug has an overall length of no more than one and one half inches.

16. The plug according to claim 10, wherein the plug base and prong assembly are configured such that their cross sectional areas, at the plane where the plug base meets the prong assembly, are substantially of the same shape and substantially of equal area.

17. A multi-piece electrical plug comprising:

an injection molded prong assembly comprising at least two mutually electrically insulated prongs wherein each prong is electrically conductively connected to a receiving prong assembly terminal, and wherein the prongs are configured to be received in a conventional electric receptacle;

an injection molded plug base comprising at least two mutually insulated protruding plug base terminals wherein each plug base terminal is electrically conductively connected to a separate conductor of an electric cord and wherein the electrical connection between each protruding terminal and each conductor is encapsulated in plastic; and a nonpermanent attachment device;

wherein the plug base is immovably secured relatively to the prong assembly by the attachment device and the protruding plug base terminals are received in the receiving prong assembly terminals, and wherein each prong of the prong assembly is electrically conductively connected to a separate conductor of the electric cord.

18. The plug according to claim 17, wherein the plug base and the prong assembly are configured such that there is a substantially smooth transition between the outer dimensions of the plug base and the prong assembly.

19. The plug according to claim 17 wherein the power cord connects the multi-piece electrical plug to a power tool.

20. The plug according to claim 17 wherein the receptacle is configured according to a NEMA standard.

* * * * *